US005134437A

United States Patent [19]

Maruta et al.

[11] Patent Number: 5,134,437

[45] Date of Patent: * Jul. 28, 1992

[54] IMAGE DUPLICATING APPARATUS HAVING MULTIPLE EDITING CAPACITY

[75] Inventors: Syuzi Maruta, Toyokawa; Masazumi Ito, Toyohashi, both of Japan

[73] Assignee: Minolta Camera Co., Ltd., Osaka, Japan

[ * ] Notice: The portion of the term of this patent subsequent to Dec. 5, 2006 has been disclaimed.

[21] Appl. No.: 382,433

[22] Filed: Jul. 19, 1989

Related U.S. Application Data

[63] Continuation-in-part of Ser. No. 126,425, Nov. 30, 1987, Pat. No. 4,885,609.

[30] Foreign Application Priority Data

Dec. 1, 1986 [JP] Japan ..... 61-286216
Jan. 26, 1987 [JP] Japan ..... 62-15875

[51] Int. Cl.[5] ..... G03G 21/00
[52] U.S. Cl. ..... 355/202; 355/218
[58] Field of Search ..... 355/202, 204, 210, 218

[56] References Cited

U.S. PATENT DOCUMENTS

| | | | |
|---|---|---|---|
| 4,582,417 | 4/1986 | Yagasaki et al. | 355/218 |
| 4,627,707 | 12/1986 | Tani et al. | 355/218 |
| 4,653,899 | 3/1987 | Watanabe | 355/218 |
| 4,687,317 | 8/1987 | Appel et al. | 355/218 |
| 4,701,044 | 10/1987 | Horiuchi et al. | 355/218 |
| 4,707,109 | 11/1987 | Kanno et al. | 355/218 |
| 4,745,491 | 5/1988 | Kishi et al. | 355/202 X |
| 4,746,953 | 5/1989 | Knodt | 355/311 |
| 4,855,786 | 8/1989 | Ohira et al. | 355/218 |
| 4,885,609 | 12/1989 | Maruta et al. | 355/202 |
| 4,887,129 | 12/1989 | Shenoy et al. | 355/218 |

*Primary Examiner*—Fred L. Braun
*Attorney, Agent, or Firm*—Price, Gess & Ubell

[57] ABSTRACT

An image duplicating apparatus having an ordinary copy mode and multiple editing modes of copying operation is provided. Editing information can be inserted directly from a control panel having a display screen or from an external editor. In operation, the last mode of editing which is selected will predominate and will determine the particular editing of the information.

12 Claims, 17 Drawing Sheets

START
INITIALIZE
A01
START TIME COUNTING
A02
ENTERED DATA STORAGE
A03
ORDINARY/EDITED COPY MODE SHIFT
A04
EDITED AREA COORDINATE DISPLAY
A05
ERASE/COPY AREA SHIFT
A06
COPYING OPERATION CONTROL
A07
COORDINATE RE-ORDERING
A08
SELECTIVE ERASE CONTROL
A09
SIGNAL OUTPUT/INTER-CPU COMMUNICATION
A10
TIMED OUT
NO
A11
YES

START
INITIALIZE
START MAIN TIMER
SEC1 JUST ISSUED
SEC2—0 ; Fen—0
ACTIVATE I/O
Fen=1
COPYING IN PROGRESS
ERASER CONTROL
MAIN TIMER TIMED OUT
DATA ENTERED
n<2
STORE DATA
n—n+1
142 ON
144 ON
146 ON
148 ON
Fer—1
Fir—1
Fen—1
Sec2—1
INTERRUPT
INTER—CPU COMMUNICATION
RETURN
YES
NO

ERASER CONTROL

J21
TIMING SENSOR OUTPUT
NO
YES
J22
SEC1 = 0
NO
J23
TURN OFF Lo - Ln
YES
J24
Ftr = 1
NO
YES
J25
J26
TURN ON Lo-Ln
TURN OFF Lo-Ln
START TIME "XA"
J27
START TIME "XB"
J28
NO
"XA" TIMED OUT
J29
YES
J30
Etr = 1
NO
YES
J31
J32
TURN OFF Lc-Ld
TURN ON Lc-Ld
NO
"XB" TIMED OUT
J33
YES
J34
Ftr = 1
NO
YES
J35
J36
TURN ON Lo-Ln
TURN OFF Lo-Ln
RETURN

IMAGE DUPLICATING APPARATUS HAVING MULTIPLE EDITING CAPACITY

CROSS REFERENCE TO RELATED APPLICATION

This is a continuation-in-part application from U.S. Pat. application Ser. No. 07/126,425 filed Nov. 30, 1987, now U.S. Pat. No. 4,885,609.

FIELD OF THE INVENTION

The present invention relates to an image duplicating apparatus and particularly to an electrophotographic image duplicating apparatus such as a copying apparatus of the type having edited image forming and data input capabilities. More particularly, the present invention relates to an electrophotographic image duplicating apparatus including an external edited data input unit having edited image forming and data input capabilities.

BACKGROUND OF THE INVENTION

An electrophotographic copying apparatus having edited image forming and data input capabilities is known which includes an external edited data input unit (hereinafter referred to as editor module) also having such capabilities. A copying apparatus of this type is per se equipped with means enabling the operator to select the edited copy mode of operation and entering data with which the edited copy mode of operation is to be carried out in the apparatus. Such edited copy mode select and data input means include a set of manually operated control keys arranged on, for example, the control panel of the apparatus. Such control keys include a key for selecting an edited copy mode of operation, and keys for specifying a desired limited area or, particularly, the coordinates defining such an area, of a document sheet within which images are to be reproduced in the edited copy mode.

The eraser unit is provided in addition to such eraser unit select and data input means and has manually operated control keys to be used to achieve functions essentially similar to the edited image forming and data input capabilities of the apparatus per se. The eraser unit further has a panel surface (hereinafter referred to as tablet) on which a document sheet to be duplicated in an eraser unit may be placed. By manually applying a localized pressure to desired points of such a tablet, the operator can designate any desired graphical pattern or area (hereinafter referred to as edited copy area) defined by the coordinate points respectively specified by the depressed points of the tablet. Thus, the copying apparatus may perform an eraser unit operation either at a request from the control panel of the apparatus per se or at a request from the external eraser unit.

SUMMARY OF THE INVENTION

It is an important object of the present invention to provide an image duplicating apparatus of the described type improved to provide ease of manipulation for the copying operation in an eraser unit.

In accordance with the present invention, there is provided an image duplicating apparatus comprising a) a main body including copying means capable of copying images on a desired area of a document, first input means for entering data designating the desired area of the document, and memory means for storing the data entered by the first input means, b) an additional device connectable to the main body and comprising second input means for entering data designating the desired area of the document, c) first control means for controlling the copying means on the basis of the data stored in the memory means, d) second control means for controlling the copying means on the basis of the data entered by the second input means when the data is entered from the second input means with data preliminarily stored in the memory means by the first input means, the second control means being further operative to maintain the first control means inoperative, and e) memory control means for controlling the memory means for retaining the preliminarily stored data therein.

The image forming means of the duplicating apparatus thus constructed may be implemented by an electrophotographic copying apparatus. In this instance, the image information to be reproduced by the apparatus may be provided in the form of optical or electrical information or in the form of analog or digital information. Furthermore, the copying conditions which can be used in the edited copy mode of operation in the apparatus according to the present invention may include erasure of a localized area, selection of the color or colors in which prints are to be produced, addition of handwritten letters, numerals and/or signs, and choice between printing on a single face and printing on the opposite faces of a copying sheet. While, in addition, an editor module having a tablet may be used typically as the external editing data input means in the apparatus according to the present invention, any other types of devices such as personal computers, optical discs, magnetic discs and various types of memory devices of, for example, the card type may be used as such data input means insofar as the device has edited image forming and numerical data entering capabilities.

BRIEF DESCRIPTION OF THE DRAWINGS

The features and advantages of an image duplicating apparatus according to the present invention will be more clearly appreciated from the following description taken in conjunction with the accompanying drawings in which.

DESCRIPTION OF THE PREFERRED EMBODIMENTS

Figure 1:
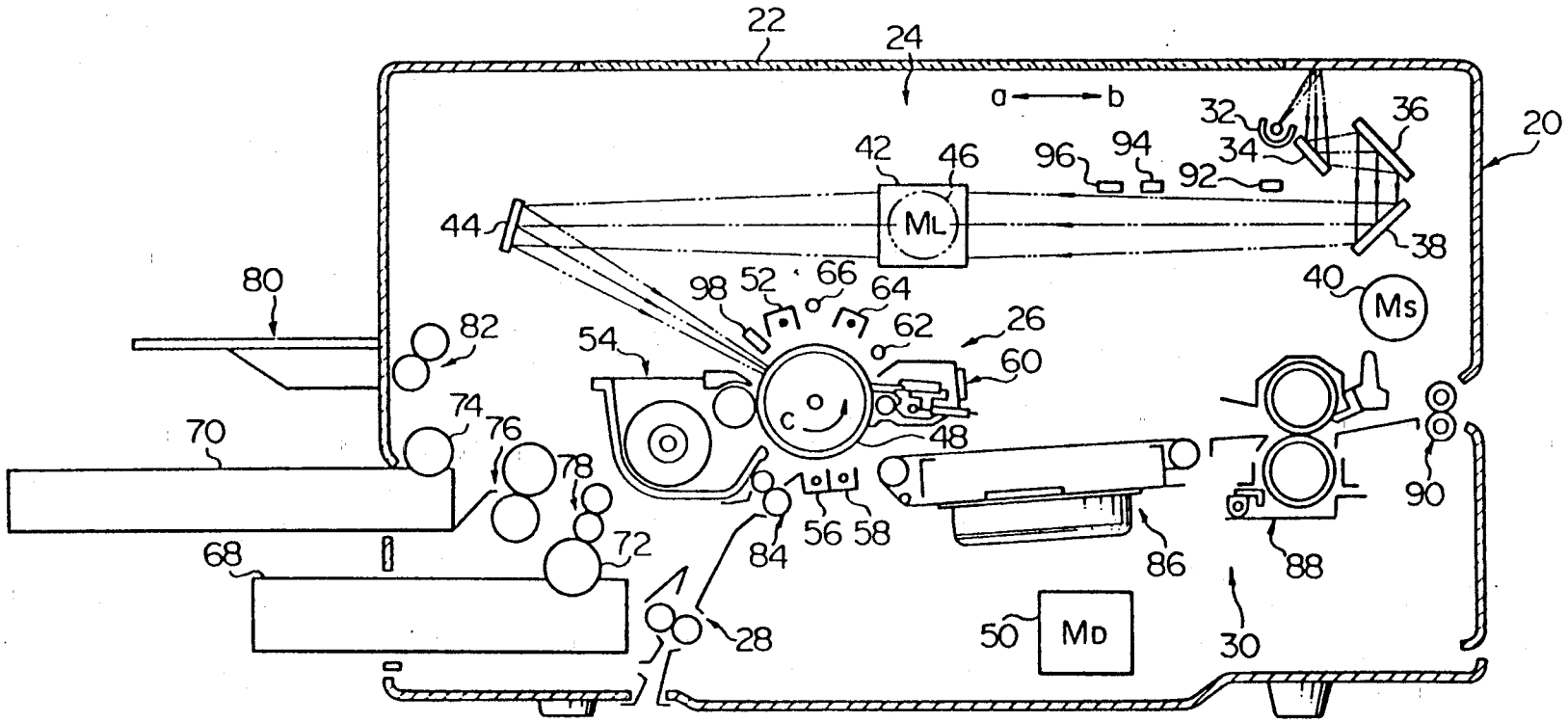
FIG. 1 is a side elevation view showing the general mechanical construction and arrangement of a preferred embodiment of an image duplicating apparatus according to the present invention.

As shown in FIG. 1, an image duplicating apparatus (hereinafter referred to as copying apparatus) embodying the present invention comprises a housing 20 having an upper panel portion provided in part by a transparent document table 22. A sheet of document sheet (not shown) bearing images to be reproduced is to be placed on this document table 22.

During duplication operation of the apparatus, the document sheet placed on the document table 22 is optically scanned by illumination with light from an optical scanning system 24. A resultant beam of light carrying information representative of the images on the scanned document sheet is directed to an image reproduction system 26. The images thus carried by the light beam are provisionally recorded in the form of latent images, which are then developed into visible images through an electrophotographic process performed by the image reproduction system 26. The visible images are transferred to any record medium such as typically a copying sheet transported by a copy sheet feed mechanism 28 and the copy sheet now carrying the reproduced images is withdrawn from the apparatus by means of an image-fixing and sheet discharge system 30.

The optical scanning system 24 is of the slit exposure type and comprises an exposure lamp 32 from which a beam of light is incident on and reflected from the lower face of the document sheet on the table 22. The light reflected from the document sheet is incident onto an object mirror 34 and is re-directed rearwardly therefrom. The lamp 32 and object mirror 34 are carried on a common movable support member (not shown) and implement a document scanner 32/34 in the apparatus embodying the present invention. The document scanner 32/34 is movable back and forth along the document table 22 as indicated by arrows a and b and has, with respect to the document table 22, a predetermined home position which corresponds to one end of the table 22. The light reflected from the object mirror 34 is re-directed toward a mirror 36, which further re-directs the light downwardly toward another mirror 38. The mirrors 36 and 38 are also carried on a common movable support member (not shown) and are movable along the document table 22 into and out of predetermined home positions indicated by full lines. The document scanner 32/34 and mirror pair 36/38 are operatively coupled to common drive means comprising a scanner drive motor 40 ($M_S$) implemented by a d.c. reversible motor so that the former is driven to travel at a speed doubling the speed of movement of the latter. From the mirror 38, the light travels forwardly along the document table 22 and is passed through an image magnification/reduction lens unit 42 to a projecting mirror 44. The lens unit 42 is movable along the document table 22 independently of the document scanner 32/34 and mirror pair 36/38 with respect to the table 22. The lens unit 42 is thus operatively coupled to drive mean comprising a lens drive motor 46 ($M_L$) which may be implemented by a d.c. stepper motor. The projecting mirror 44 is herein assumed to be fixedly held with respect to the housing 20 but, where desired, may be supported to be movable and/or rockable with respect to the housing 20.

On the other hand, the image reproducing system 26 of the apparatus comprises a cylindrical image transfer drum 48 having a photoconductive peripheral surface. The light incident on the projecting mirror 44 is re-directed toward and projected onto the peripheral surface of this image transfer drum 48 which is driven for rotation in a direction indicated by arrow c. The document scanner 32/34 and mirror pair 36/38 are driven for movement at speeds proportional to the peripheral speed (V) of rotation of the image transfer drum 48. Movement of the lens unit 42 in either direction with respect to the mirror 44 results in a change in the position of the unit 42 with respect to the peripheral surface of the drum 48 and accordingly in a change in the magnification/reduction ratio (N) of the images to be reproduced. Thus, the lens unit 42 implements magnification ratio adjust means for adjusting the magnification/reduction ratio (hereinafter referred to simply as magnification ratio) of the images to be reproduced. In the embodiment herein shown, it is assumed that the document scanner 32/34 is driven for movement at a speed V/N and the mirror pair 36/38 at a speed V/2N.

The image reproducing system 26 further comprises a main charger 52 to sensitize the photoconductive peripheral surface of the image transfer drum 48. Posterior to the path of light from the mirror 44 to the drum 48 is located an image developing unit 54 having a stock of toner particles to be applied to the peripheral surface of the image transfer drum 48. Posterior to the developing unit 54 in turn is provided an image transfer charger 56 which is operative to charge the copy sheet so that the toner images on the drum 48 are transferred to the copy sheet. The copy sheet thus having the toner images carried thereon is cleared of charges by a separation charger 58 which is located posterior to the transfer charger 56. There is further provided a drum cleaner unit 60 which removes any residual toner particles from the peripheral surface of the drum 48. Posterior to this cleaner unit 54 in turn is located a charge eraser lamp 62 which irradiates the cleaned peripheral surface of the drum 48 to eliminate the charges which may be left thereon. The image reproducing system 26 herein shown further comprises an auxiliary charger 64 and an auxiliary charge eraser lamp 66 which may be by preference provided depending upon the type of the duplicating apparatus or particularly the type of the image transfer drum 48.

The paper feed mechanism 28 is provided in conjunction with paper supply cassettes 68 and 70 detachably fitted to the housing 20 and which have stocks of copy sheets of different sizes encased therein. The paper feed mechanism 28 per se comprises first and second paper feed rollers 72 and 74 associated with the cassettes 68 and 70, respectively. Each of these rollers 72 and 74 is driven for rotation for picking up copying sheets one after another from the stack of paper in the associated one of the cassettes 68 and 70. A copying sheet picked up by the first paper feed roller 72 is directly passed toward the image transfer drum 48. A copying sheet picked up by the second paper feed roller 74 is passed through a first pair of guide rollers 76 to a second pair of guide rollers 78 and from the second pair of guide rollers 76 toward the image transfer drum 48. In the apparatus herein shown, there is further provided a manual paper feed tray 80 so that a copying sheet manually inserted through this tray 80 in the housing 20 is transported through a third pair of guide rollers 82 and via the first and second pairs of guide rollers 76 and 78.

Immediately posterior to the developing unit 52 is provided a pair of timing rollers 84. A copying sheet which has been transported toward the image transfer drum 48 from the first paper feed roller 72 or through the second guide rollers 78 is brought into contact with the peripheral surface of the drum 48 by means of these timing rollers 84. The timing rollers 84 are driven for rotation at a timing synchronized with the movement of the document scanner 32/34 so that the copying sheet is correctly transferred to the drum 48. The timing rollers 84 are further operative to rectify the direction of the copying sheet to be fed to the peripheral surface of the drum 48.

A copy-sheet transport belt assembly 86 is positioned posterior to the area where the copy sheet is to be separated from the image transfer drum 48. The copy sheet separated from the drum 48 is thus conveyed rearwardly through the belt assembly 86 to an image fixing assembly 88 provided at the rear of the belt assembly 86. The toner particles carried on the copy sheet are thermally fused and the toner images fixed on the copy sheet by means of this image fixing assembly 88. The copy sheet released from the image fixing assembly 88 is withdrawn from the apparatus through a pair of paper discharge rollers 90 and a slot provided in the rear panel portion of the housing 20.

Various sensors and detectors are provided which include a home position sensor 92 and first and second scan timing sensors 94 and 96 located in conjunction with the document scanner 34/36. The home position sensor 92 produces a home position signal ($S_{HP}$) of a logic "1" bit in the presence of the document scanner 32/34 in the home position thereof. Each of the first and second scan timing sensors 94 and 96 produces an output signal as the scanner 32/34 is driven for movement over predetermined distances from its home position with respect to the document table 22. Also provided is a sensor (not shown) for detecting the position of the lens unit 22 with respect to the image transfer drum 48.

In the embodiment of the present invention, there is further provided an eraser unit 98 which is located in the vicinity of the main charger 52 for being actuated when the apparatus is conditioned to carry out the edited copy mode of operation. Details of such an eraser unit 98 will be described later.

Figure 2:
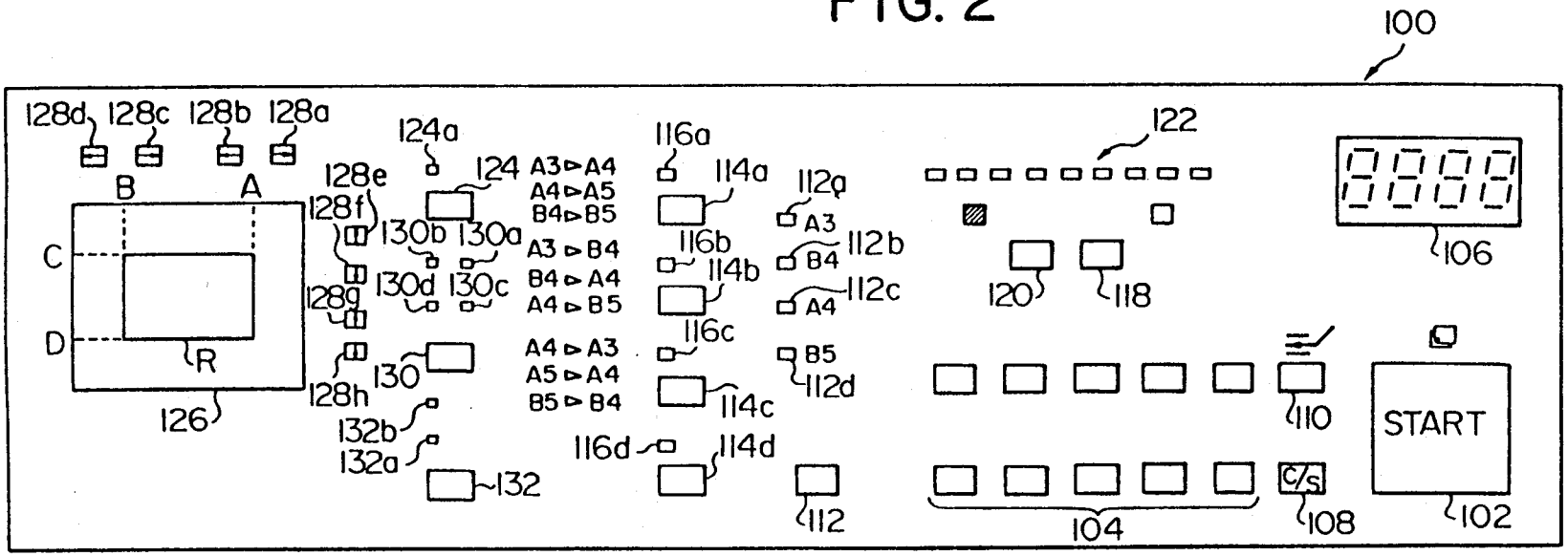
FIG. 2 is a plan view schematically showing the general configuration of a control panel forming part of the image duplicating apparatus illustrated in FIG. 1.

FIG. 2 shows the general configuration of a control panel 100 which forms part of the apparatus embodying the present invention. The control panel 100 comprises a print start switch 102 (START) to start duplicating operation and a set of numerical switches 104 allocated to numerals 1, 2, . . . and 0, respectively and used to enter a selected quantity of copy sheets to be printed. The quantity of copy sheets thus entered from the numerical switches 104 is displayed on a seven-segment display window 106 and can be cleared from a clear/-stop switch 108 (C/S) which may be used also for cancelling the instruction once entered from the print start switch 102. During printing of a preset quantity of copy sheets for a given document sheet, another document sheet may be duplicated in an interrupt mode entered at an interrupt request switch 110 (IR). The numerical switches 104 is to be used not only for entering a selected quantity of copy sheets to be printed but for numerical data representative of the coordinates to define a desired edited copy area to be specified during an edited copy mode of operation. The numerical data thus entered from the switches 104 are also displayed on the display window 106.

The size of copy sheets to be used can be selected at a manual paper-size select switch 112 (SIZE) from among a predetermined number of sizes available. The selected size of copy sheets is displayed by any of paper-size indicators **112*a* to 112*d* which are assumed to be assigned to the standard A3, B4, A4 and B5 sizes, respectively, as shown. The paper-size select switch 112 is, in effect, operative to select one of the paper supply cassettes 68 and 70 currently assembled to the apparatus shown in FIG. 1. In the control panel 100 are further provided a set of magnification ratio select switches 114*a* to 114*d* and respectively associated indicators 116*a* to 116*d*. With one of the switches 114*a* to 114*d* depressed, the associated one of the indicators 116*a* to 116*d* illuminates to indicate the selected ratio of magnification. Further provided are print density increment and decrement switches 118 and 120 to permit manual selection of a desired print density for the copy sheets to be printed. The print density is stepwise incremented with the switch 118 depressed or decremented with the switch 120 depressed. A series of print density display indicators 122 are activated to illuminate successively in one direction with the increment switch 118 kept depressed and in the other direction with the decrement switch 120** kept depressed.

In the control panel 100 are further provided switches and indicators for selecting the edited copy mode of operation and entering data necessary for executing the edited mode of copying operation. These switches and indicators include a copy mode shift switch 124 to make a shift between ordinary and edited copy modes of operation and an associated indicator 124*a* to be turned on when the edited copy mode is selected. When the copy mode shift switch 124 is depressed and the associated indicator 124*a* turned, there is produced an edited copy mode request signal $S_{ECI}$ of a logic "1" level calling for execution of the edited mode of copying operation based on the control and data signals from the control panel 100. This edited copy mode request signal $S_{ECI}$ of logic "1" level is maintained as it is until the edited mode of copying operation is thereafter cancelled. An edited copy area display screen 126 is provided on which a edited copy area R defined by the coordinate data entered is to be visually indicated. Such coordinate data are specified from any of first to eighth coordinate select switches 128*a* to 128*h* enter switch 130 having associated first and second indicators 130*a* to 130*d*. There are further provided an area erase switch 132 and associated first and second indicators 132*a* and 132*b*. As will be described in more detail, the indicators 132*a* and 132*b* are to be turned on when "inside area" and "outside area" erase modes of operation are respectively selected.

In the presence of the edited copy mode request signal $S_{ECI}$ of a logic "1" level with the copy mode shift indicator 124*a* turned on, there is displayed on the display screen 126 a rectangular edited copy area R defined by a first x-coordinate "A" designated from the switches 128*a* and 128*b*, a second x-coordinate "B" designated from the switches 128*c* and 128*d*, a first y-coordinate "C" designated from the switches 128*e* and 128*f*, and a second y-coordinate "D" designated from the switches 128*g* and 128*h* as shown in FIG. 2. When each of these coordinates "A", "B", "C" and "D" is designated from the switches 128*a* to 128*h*, the numerical data representative of each of the coordinates is indicated on the display window 106 and is entered with the coordinate enter switch 130 depressed. When the coordinate enter switch 130 is depressed repeatedly, the associated indicators 130*a* to 130*d* are turned on to illuminate recursively in this sequence. Each of the indicators thus provided on the control panel 100 is of the type using a light emitting diode (LED).

Figure 3:
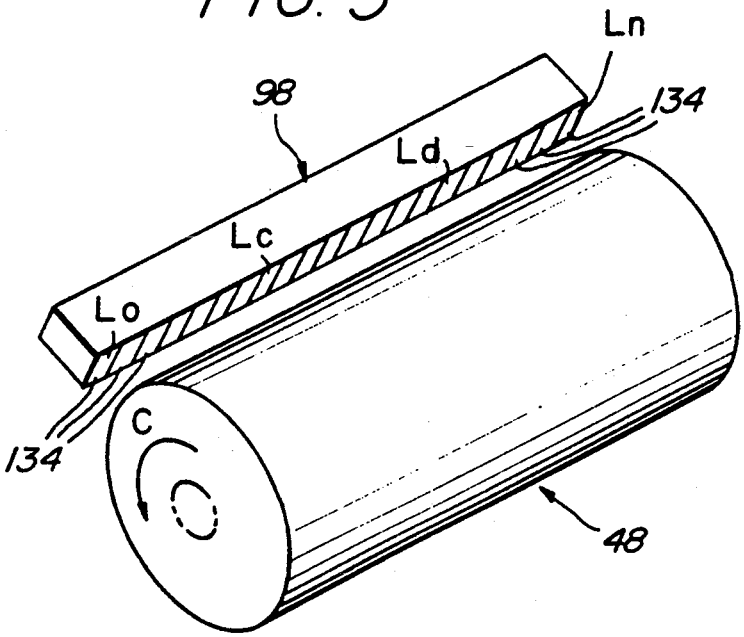
FIG. 3 perspective view showing, to an enlarged scale, the general arrangement of the eraser unit incorporated in the image duplicating apparatus embodying the present invention and positioned in conjunction with the photosensitive image transfer drum which forms part of the duplicating apparatus.

In FIG. 3 is shown to an enlarged scale the arrangement including the eraser unit 98 incorporated in the copying apparatus embodying the present invention and positioned in conjunction with the image transfer drum 48. As has been shown in FIG. 1, the eraser unit 98 is located anterior, in the direction c of rotation of the image transfer drum 48, to the path of light from the projecting mirror 44 to the peripheral surface of the drum 48. If desired, however, the eraser unit 98 may be located posterior, in the direction c of rotation of the drum 48, to the path of light from the projecting mirror 44 to the drum 48. As further depicted in FIG. 3, the eraser unit 98 is composed of a number of light emitter elements 134 (Lo–Ln) arranged in a single array. The array of the light emitter elements 134 is positioned close to the peripheral surface of the image transfer drum 48 and extends in parallel to the axis of rotation of the drum 48. When the light emitter elements 134 of such an eraser unit are activated to illuminate selectively with the drum 48 being driven for rotation, the charges on those small areas of the drum surface which are illuminated by the selected light emitter elements 134 are caused to disappear. Accordingly, no latent images can be produced on the particular areas of the drum surface when the drum surface is irradiated with an information carrying beam. It will be apparent that, where the eraser unit 98 is located posterior to the path of light to the peripheral surface of the drum 48, the latent images which have once been produced on the drum surface are to be destroyed by irradiation from the selected ones of the light emitter elements 134.

Figure 4:
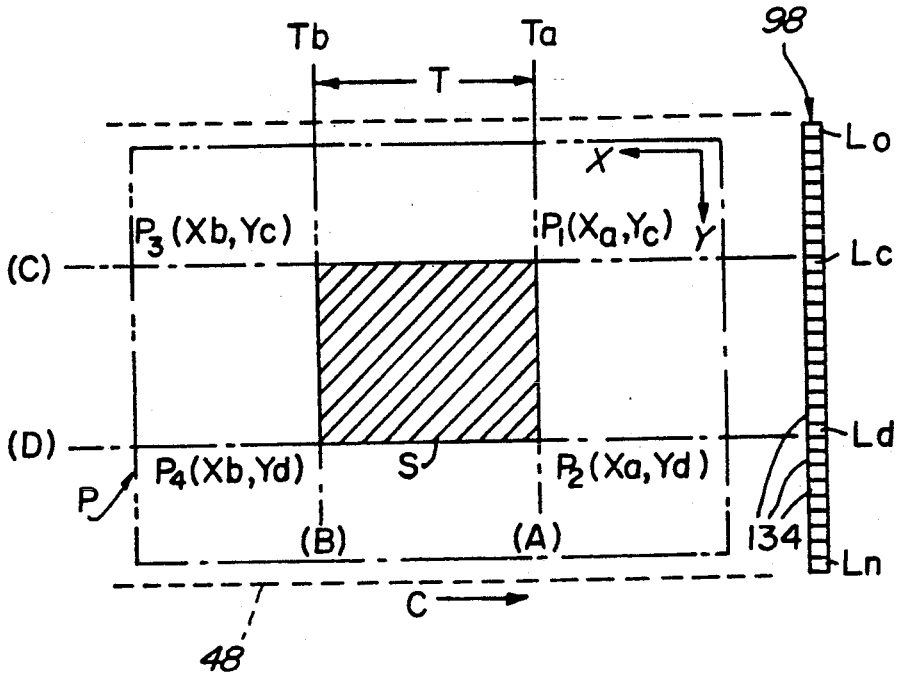
FIG. 4 is a plan view showing, in conjunction with the eraser unit shown in FIG. 3, an example of an edited copy area which may be displayed on the control panel shown in FIG. 2.

FIG. 4 shows, in conjunction with the eraser unit 98, an edited copy area R which may be displayed on the display screen 126 of the control panel 100 illustrated in FIG. 2. For purposes of description, it is herein assumed that, out of the light emitter elements Lo to Ln forming the eraser unit 98, the adjacent light emitter elements Lc to Ld are activated to illuminate from time Ta to time Tb. Furthermore, an xy-coordinate system is taken on the peripheral surface of the image transfer drum 48 which is shown developed. As shown, the xy-coordinate system has an axis of abscissa in the direction of circumferential direction of the drum 48 and an axis of ordinate in the axial direction of the drum 48 with an origin at the right upper corner of a copying paper P indicated by phantom lines. The direction indicated by arrow C along the axis of abscissa corresponds to the direction of rotation c of the image transfer drum 48 as shown in FIG. 1. When the light emitter elements Lc to Ld are activated from time Ta to time Tb, the charges are caused to dissipate on the area S of the drum surface as defined by the four coordinate points (Xa, Yc), (Xa, Yd), (Xb, Yc) and (Xb, Yd) given by the x-coordinates Xa and Xb respectively corresponding to the times Ta and Tb and the y-coordinates Yc and Yd respectively corresponding to the light emitter elements Lc and Ld There can thus be produced no latent images within this area S when the drum 48 is illuminated with an information carrying beam incident on the drum surface. If it is assumed that the total area of the copying paper P as herein shown corresponds to a total or limited area of the document sheet to be duplicated in the edited copy mode, no visible images can be reproduced within the area of the copying paper which corresponds to the area S which is herein shown hatched. The area S is displayed as the edited copy area R on the display screen 126 on the control panel 100 shown in FIG. 2 and, thus, the coordinates Xa, Xb, Yc and Yd which give the above mentioned four coordinate points respectively correspond to the coordinates "A", "B", "C" and "D" defining the edited copy area R irradiated by the light emitter elements Lc to Ld.

Figure 5:
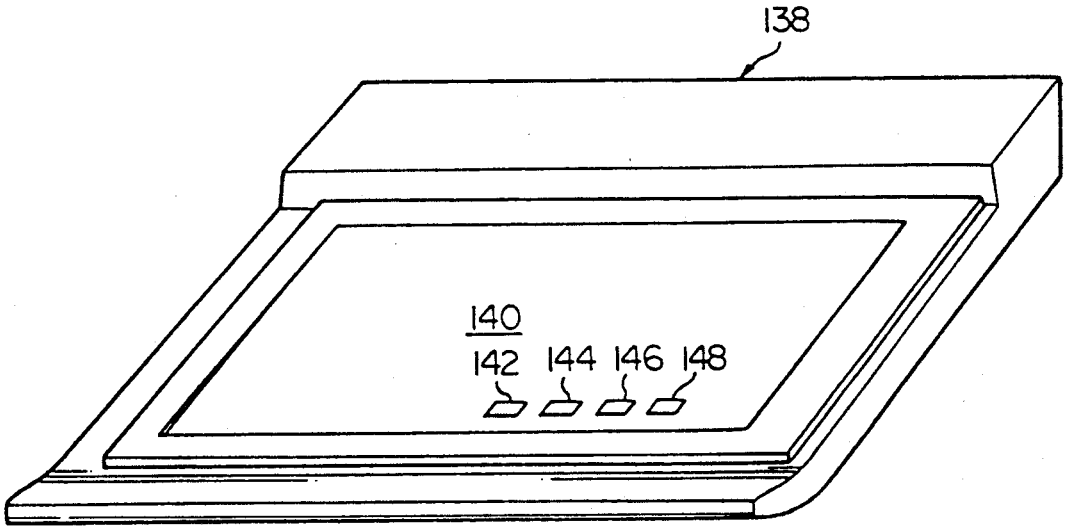
FIG. 5 is a perspective view of the editor module also included in the image duplicating apparatus embodying the present invention.

The copying apparatus embodying the present invention further comprises an external edited data input unit implemented by an editor module 138 illustrated in FIG. 5. The light emitter elements 134 of the eraser unit 98 as above described can also be selectively activated on the basis of signals supplied from this external editor module 138. Thus, the edited mode of copying operation of the apparatus embodying the present invention can be executed under the control of either signals from the control panel 100 of the apparatus per se or signals from the editor module 138. Such an external editor module 138 is placed on, for example, the upper panel portion of the housing 20 and includes a graphic data input device implemented by a tablet 140 and instruction input switches 142, 144, 146 and 148. The table 140 consists of a matrix formed by a number of transparent resistor lines arranged in rows and columns at pitch distances of, for example, 1 mm. Application of a pressure to the tablet 140 at any desired point thereof causes one of the row resistor lines and one of the column resistor line to form a short circuit so that an electric signal is produced which is indicative of the x-coordinate assigned to the particular column resistor line and the y-coordinate assigned to the particular row resistor line. When, thus, a document sheet to be duplicated in the edited copy mode is placed on the tablet 140 and the tablet 140 is manually pressed upon through the document sheet at any desired point of the tablet 140, the coordinates uniquely representative of the particular point can be entered from the editor module 138. The instruction input switches provided on such an editor module 138 consist of an erase request switch 142, a trimming request switch 144, an end switch 146 and a clear switch 148. The erase request switch 142 is used to select the edited copy mode for totally erasing a particular edited copy area of a copy paper, viz., to select an "inside area" erase or "outside area" copy mode, while the trimming request switch 144 is used to select the edited copy mode for totally erasing an area surrounding the particular edited copy area, viz., to select an "outside area" erase or "inside area" copy mode. The end switch 146 produces an edited copy mode request signal $S_{EC2}$ of a logic "1" level when depressed after the tablet 140 is depressed locally and one of the erase and trimming request switches 142 and 144 depressed. The clear switch 148 is used to cancel a request for the edited copy mode and the coordinate data for the edited copy mode which have once been entered from the editor module 138.

Figure 6:
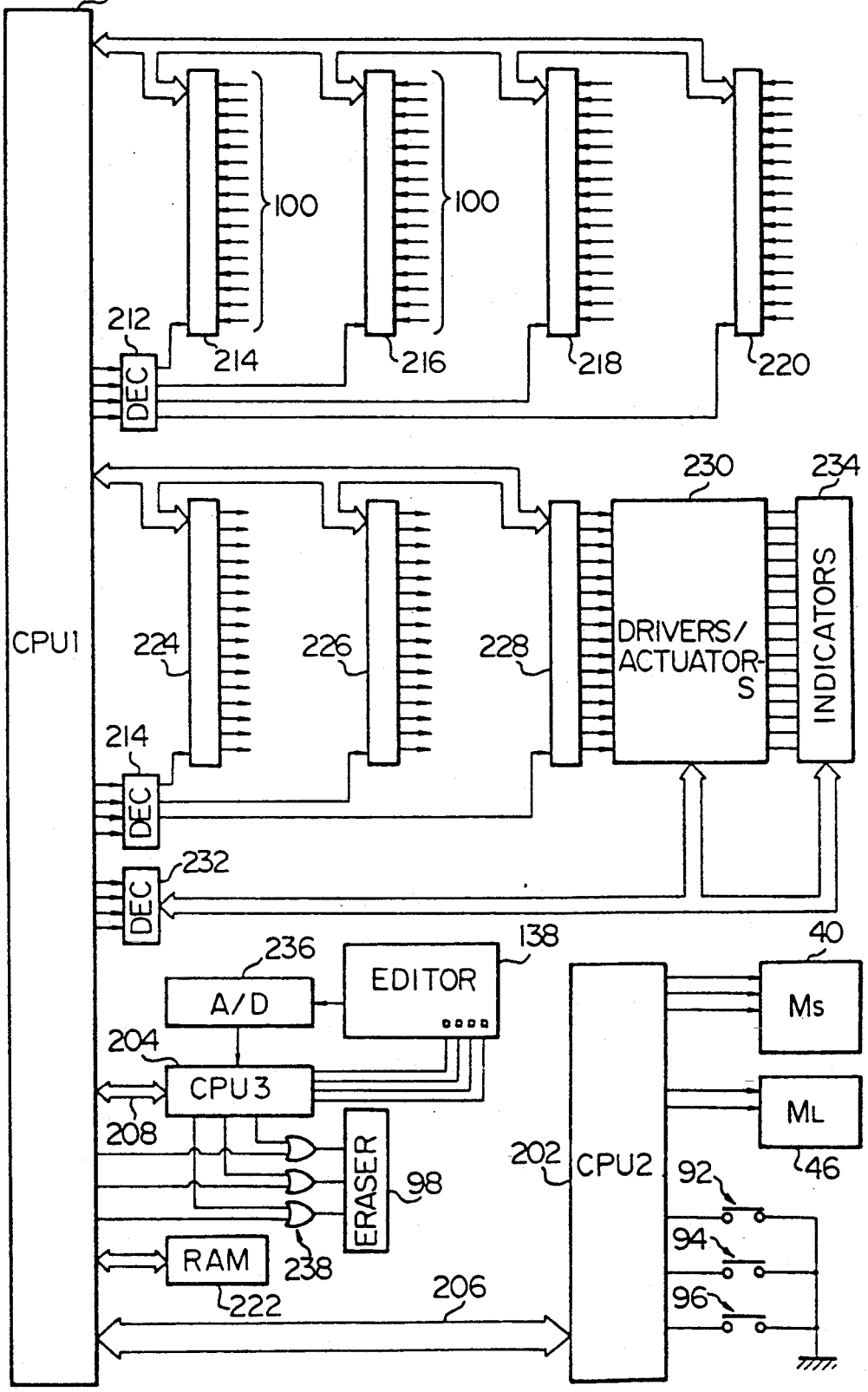
FIG. 6 is a diagram schematically showing the arrangement of a control circuit which may be incorporated in the image duplicating apparatus embodying the present invention.

FIG. 6 shows the general arrangement of a control circuit which may be used to achieve the functions described with reference to FIGS. 2 to 5. The control circuit comprises first, second and third microprocessors 200, 202 and 204 (hereinafter referred to as CPU1, CPU2 and CPU3, respectively). The CPUl 200 and CPU2 202 have interrupt and data input and output ports connected together through a bidirectional bus 206 and the CPUl 200 and CPU3 204 have interrupt and data input and output ports connected together through a bidirectional bus 208. The CPUl 200 is mainly operative to control the operation of the image reproducing system 26 and paper feed mechanism 28 while the CPU2 202 is predominant over the operation of the optical scanning system 24. The CPUl 200 is further predominant over the edited mode of copying operation of the apparatus in response to control and data signals which may be supplied from the control panel 100. The CPU2 is mainly operative to control the operation of the optical document scanning system 24. The CPU3 204 is predominant over the edited mode of copying operation of the apparatus in response to control and data signals which may be supplied from the editor module 138.

The first CPUl 200 has input terminals connected through a decoder 212 input expander circuits 214, 216, 218 and 220 and through these expander circuits 214 to 220 to various switch elements including those on the control panel 100. Data entered from such switch elements and thus including those representative of the coordinates of a desired edited copy area as entered from the numerical switches 104 of the control panel 100 are stored into a random-access memory (RAM) 222 which is connected to the CPUl through a bidirectional bus. The CPUl 200 further has output terminals connected through a decoder 214 to output expander circuits 224, 226 and 228 and through these expander circuits 224 to 228 to the drivers and actuators (herein collectively represented by numeral 230) for the main drive motor 50, the motor forming part of the developing unit 54, the clutches for the paper feed and timing rollers 72, 74 and 84, the chargers 52, 56, 58 and 66, the eraser lamps 62 and 66 and further to the individual light emitter elements 134 of the eraser unit 98. The CPUl 200 is thus operative to control the image reproducing system 26 and paper feed mechanism 28 and, in addition, the eraser unit 98 in response to control and data signals from the control panel 100. The CPUl 200 is further connected through a decoder 232 to the various indicators (herein collectively represented by numeral 234) on the control panel 100 including the display window 106 and display screen 126.

The second CPU2 202 has input terminals connected to the home position sensor 90 and scan timing sensors 94 and 96 provided in association with the optical scanning system 24 and is operative to control the driver circuits for the scanner drive motor 40 and the stepper motor 46 for the magnification lens unit 42. The CPU2 202 is thus responsive to signals from the home position and scan timing sensors 92, 94 and 96 to regulate the operation of the motors 40 and 46 of the optical scanning system 24 under the control of the first CPUl 200 through the bus 206.

The third CPU3 204 has input terminals connected some directly and some through an analog-to-digital converter 236 to the external editor module 138 and output terminals connected to the light emitter elements 134 of the eraser unit 98 as shown. The CPU3 204 are thus responsive to data signals produced by the tablet 140 and control signals produced by any of the switches 142, 144, 146 and 148 of the editor module 138. The data signals representative of the specified coordinate data and the control signals representative of the selected mode of copying operation thus entered from the editor module 138 are transferred some directly and some through the analog-to-digital converter 236 to the CPU3 204. The signals representative of the coordinate data in particular are passed to an internal memory (not shown) of the CPU3 to select the addresses respectively allocated to the coordinates of the manually pressed points of the tablet 140 of the eraser unit 138. Those light emitter elements 134 of the eraser unit 98 which correspond to the selected addresses are activated by the signals thus supplied from the CPU3 204. When the end switch 146 of the editor module 138 is depressed, the CPU3 204 produces the edited copy mode request signal $S_{EC2}$ of a logic "1" level calling for execution of the edited mode of copying operation based on the control and data signals from the editor module 138. It will be apparent that the randomaccess memory 222 may be used in lieu of the internal memory of the CPU3 204 for the storage of the coordinate data entered from the tablet 140 of the editor module 138.

In the presence of the edited copy mode request signal $S_{EC1}$ of a logic "1" level from the control panel 100 and the edited copy mode request signal $S_{EC2}$ of a logic "0" level from the editor module 138, the first CPU1 200 controls the edited mode of copying operation based on the control and data signals from the control panel 100. On the other hand, the edited mode of copying operation is executed under the control of the third CPU3 204 on the basis of the control and data signals supplied from the editor module 138 in the presence of the edited copy mode request signals $SEC_1$ and $S_{EC2}$. In this connection it may be herein noted that one of these edited copy mode request signals $S_{EC1}$ and $S_{EC2}$ is swung from the logic "1" level to the logic "0" level responsive to the transition of the other of the signals $S_{EC1}$ and $S_{EC2}$ from the logic "0" level to the logic "1" level.

Figure 7:
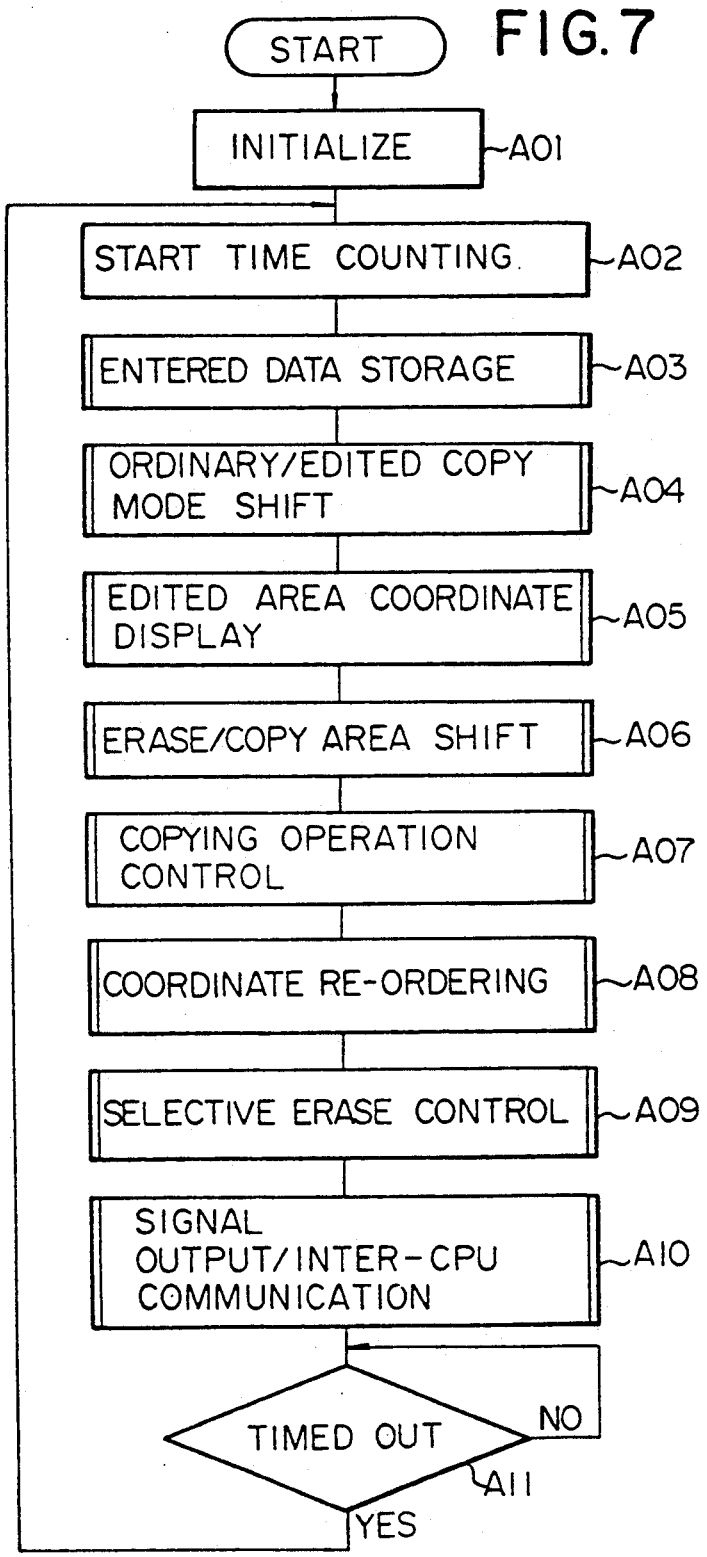
FIG. 7 is a flowchart showing the main routine program to be executed by the first microprocessor included in the control circuit illustrated in FIG. 6.

FIG. 7 shows the main routine program to be executed by the first CPU1 200. The routine program starts with step A01 to initialize the system so that all the copying conditions and modes of operation to be controlled by the system of the first CPU1 200 are selected in accordance with prescribed "default" rules. An internal timer of the system is then initiated at step A02 to count the time interval predetermined for a single complete iteration through the routine program.

Subroutine A03

The CPU1 200 may then execute an entered data storage subroutine program A03 in which the numerical data entered from the numerical switches 104 on the control panel 100 are stored depending on the status of the edited copy mode request signal $S_{EC1}$. In the presence of the edited copy mode request signal $S_{EC1}$ of a logic "0" level, the numerical data thus stored may be those indicative of the selected quantity of copy sheets to be printed and, in the presence of the signal $S_{EC1}$ of a logic "1" level, the numerical data may be those indicative of the coordinates of the desired edited copy area. The details of this subroutine program A03 will be described with reference to FIGS. 8 and 9.

Subroutine A04

The CPU1 200 may further execute an ordinary/edited copy mode shift subroutine program A04 in which the edited mode of copying operation based on the signals from the control panel 100 is established in the presence of the edited copy mode request signal $S_{EC1}$ of a logic "1" level and in the presence of the edited copy mode request signal $S_{EC2}$ of a logic "0" level. If the edited copy mode request signal $S_{EC2}$ of logic "1" level is issued from the editor module 138, the signal $SEC_1$ is shifted from logic "1" to logic "0" level to set up the edited mode of copying operation based on the signals from the editor module 138. If the edited mode of copying operation based on the signals from the control panel 100 is established at the point of time the switch 124 is depressed, the flag Fec of the signal $S_{EC1}$ is shifted from logic "1" to logic "0" level to cancel the edited mode of copying operation based on the signals from the control panel 100. The details of this subroutine program A04 will be described with reference to FIG. 10.

Subroutine A05

The CPU1 200 may further execute an edited area coordinate display subroutine program A05 in which, in the presence of the edited copy mode request signal $S_{EC1}$ of logic "1" level, the coordinate corresponding to the currently illuminating one of the indicators 130*a* to 130*d* is indicated on the display window 106 and stored into the memory 222 with the associated coordinate enter switch 130 depressed. The details of this subroutine program A05 will be described with reference to FIG. 11.

Subroutine A06

The CPU1 200 may further execute an erase/copy area shift subroutine program A06 in which a shift is made from the "inside area" erase mode to the "outside area" erase modes of edited copying operation or vice versa. The "inside area" erase mode is indicated with the first area erase indicator 132*a* turned on and the "outside area" erase mode indicated with the second area erase indicator 132*b* turned on. The details of this subroutine program A06 will be described with reference to FIGS. 12 to 14.

Subroutine A07

The CPU1 200 may further execute a copying operation control subroutine program A07 which is predominant over most of the major steps of copying operation to be carried out by the apparatus with the print start switch 102 depressed. The details of this subroutine program A07 will be described with reference to FIGS. 15A and 15B.

Subroutine A08

The CPU1 200 may further execute a coordinate reordering subroutine program A08 in which comparison is made between the two x- or y-coordinates entered from any of the coordinate select switches 128*a* to 128*d*. The two x- or y-coordinates thus compared are ordered or re-ordered in accordance with a prescribed rule so that, for example, the coordinates are arranged in an increasing order. The details of this subroutine program A08 will be described with reference to FIG. 16.

Subroutine A09

The CPU1 200 may further execute a selective erase control subroutine program A09 in which the light emitter elements 134 of the eraser unit 98 are selectively activated in relation to the rotation of the image transfer drum 48 on the basis of the numerical data representative of the coordinates thus re-ordered. The details of this subroutine program A09 will be described with reference to FIG. 17 for one preferred embodiment and to FIGS. 18A to 18C for another preferred embodiment.

Subroutine A10

The CPU1 200 may further execute a signal output/interCPU communication subroutine program A10 for communicating with the other CPUs such as the second CPU2 202 predominant over the operation of the document scanning system 24 and the third CPU3 204 predominant over the edited mode of copying operation under the control of the editor module 138.

Upon lapse of the predetermined time interval as detected at step All after the internal timer of the system has been initiated at the step A02, the system reverts to the step A02 and recycles the subroutine programs A03 to A09.

Description will now be made in regard to the details of the subroutine programs A03 to A09 thus included in the main routine program of the first CPU1 200.

Enterd Data Storage Subroutine (A03)

Figure 8:
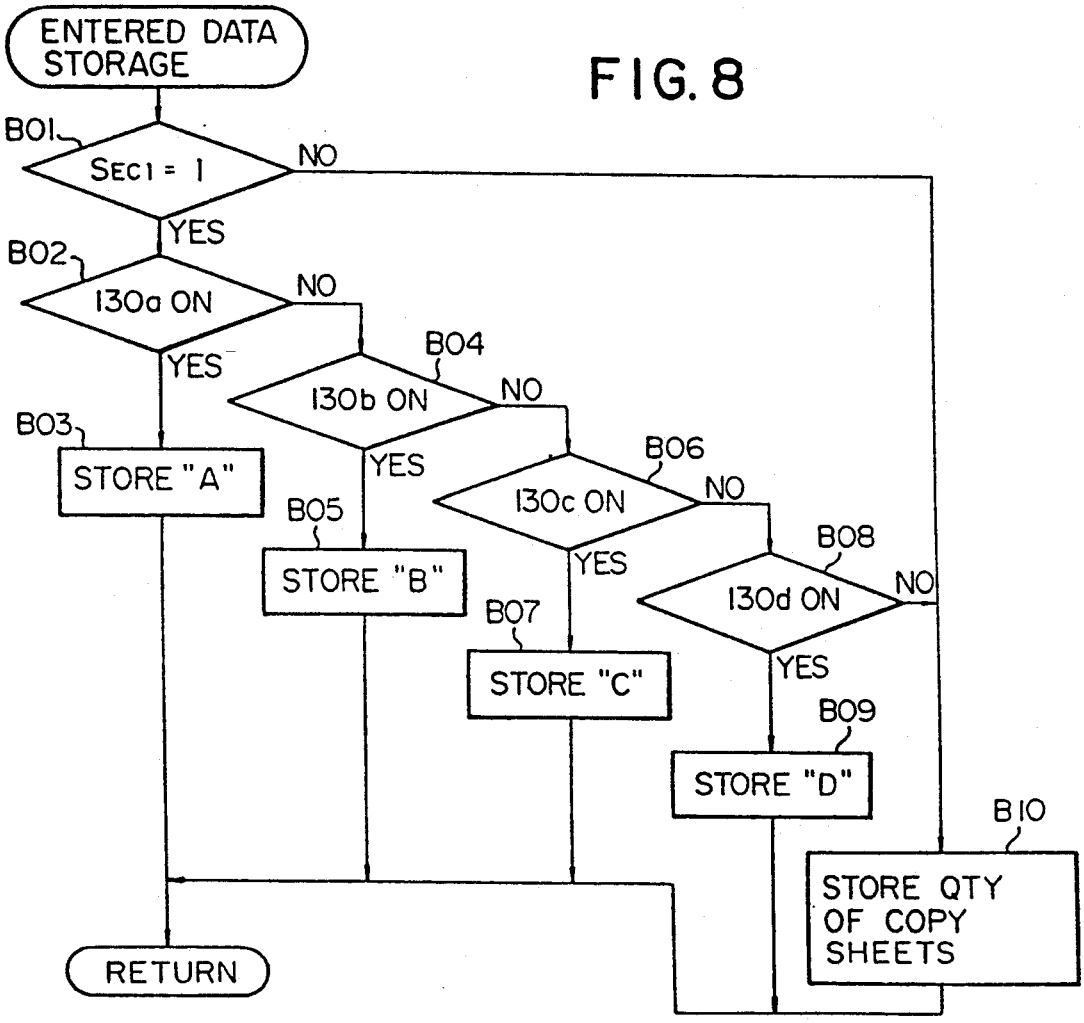
FIG. 8 is a flowchart showing an entered data storage subroutine program included in the main routine program illustrated in FIG. 7.
Figure 9:
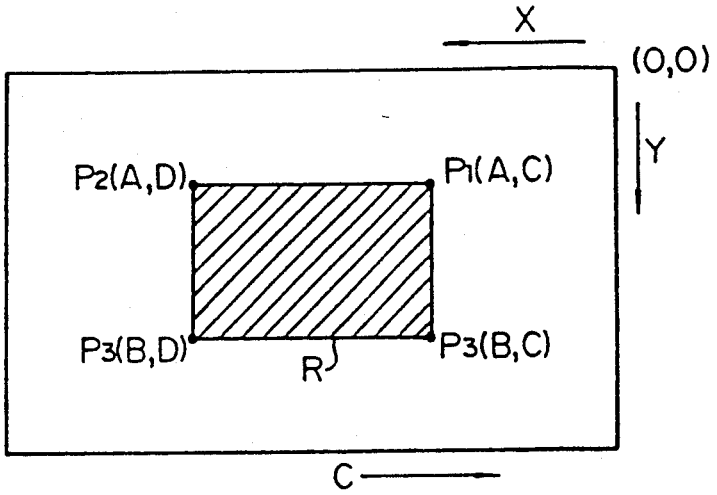
FIG. 9 is a plan view showing an edited copy area which may be displayed on the control panel illustrated in FIG. 2.

Referring to FIG. 8, the entered data storage subroutine program A03 starts with a decision step B01 to determine whether or not the edited mode of copying operation is requested from the control panel 100. For this purpose, it is questioned whether or not the indicator 124a associated with the copy mode shift switch 124 is turned on or, in other words, the edited copy mode request signal $S_{EC1}$ from the control panel 100 is of a logic "1" level. If it is determined that the indicator 124a is turned on so that the signal $S_{EC1}$ has a logic "1" level, the system proceeds to steps B02 to B09 to store the data representative of the coordinates "A", "B", "C" and "D" for the desired edited copy area R as entered from the numerical keys 104. If, thus, it is determined at step B02 that the first indicator 130a associated with the coordinate select switch 130 is turned on, the data representative of the x-coordinate "A" is stored at step B03. If it is determined at step B04 that the second indicator 130b associated with the switch 130 is turned on, the data representative of the x-coordinate "B" is stored at step B05. If it is determined at step B06 that the third indicator 130c associated with the switch 130 is turned on, then the data representative of the y-coordinate "C" is stored at step B07. If it is determined at step B08 that the fourth indicator 130d associated with the switch 130 is turned on, then the data representative of the y-coordinate "D" is stored at step B09. In these manners, the rectangular edited copy area R defined by the coordinate points $P_1$(A, C), $P_2$(A, D), $P_3$(B, C) and $P_4$(B, D) is specified on the xy-coordinate system assumed to have its origin at the right upper corner of the copying sheet P as shown in FIG. 9. On the other hand, if it is determined at the step B01 that the indicator 124a associated with the copy mode shift switch 124 is turned off, the system proceeds to step B10 to store the data indicative of the selected quantity of copy sheets to be printed.

Ordinary/Edited Copy Mode Shift Subroutine (A04)

Figure 10:
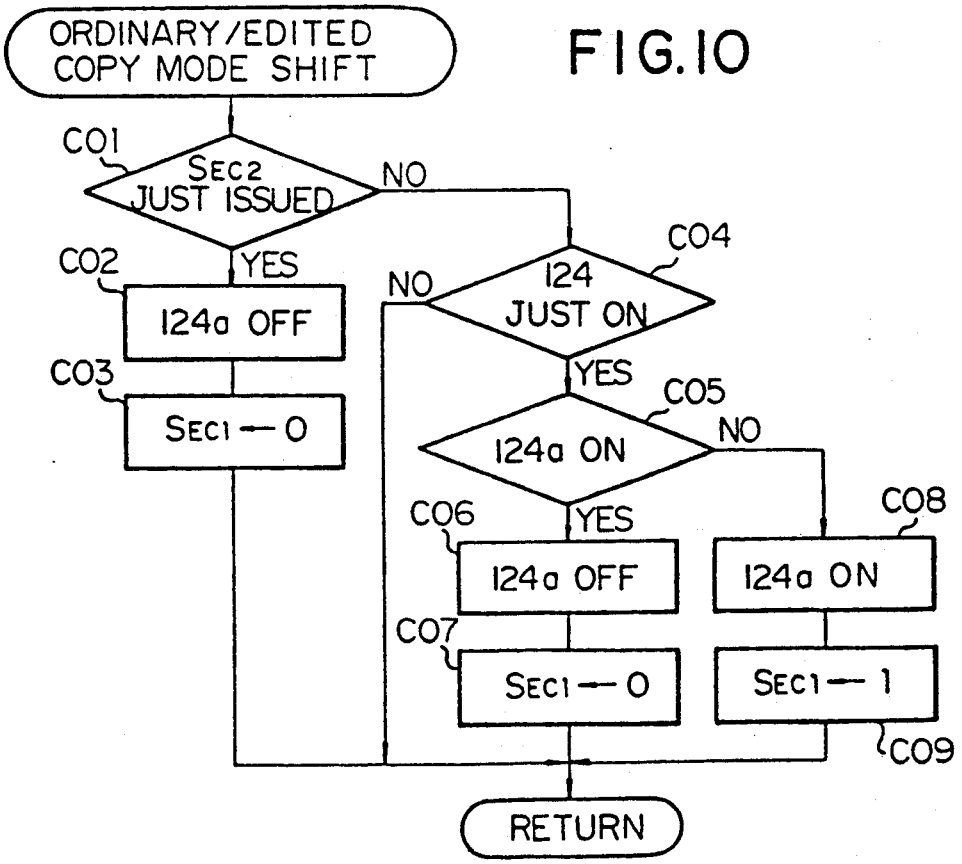
FIG. 10 is a flowchart showing an ordinary/edited copy mode shift subroutine program also included in the main routine program illustrated in FIG. 7.

Referring to FIG. 10, the ordinary/edited copy mode shift subroutine program A04 starts with a decision step C01 at which it is determined whether or not the edited mode of copying operation is requested from the third CPU3 204. For this purpose, it is questioned whether or not the edited copy area request signal $S_{EC2}$ from the editor module 138 was swung from the logic "0" level to logic "1" level during the current cycle of iteration of the main routine program. In the presence of the signal $S_{EC2}$ issued with logic "1" level, the indicator 124a associated with the copy mode shift switch 124 is turned off at step C02 and the edited copy mode request signal $S_{EC1}$ is shifted to a logic "0" level at step C03 to cancel the edited copy mode based on the signals from the control panel 100. With the copying mode of operation thus shifted to the ordinary copy mode ($S_{EC1}=0$), the system recycles the subroutine program A04. If the answer for this step C01 is given in the negative, it is further determined at step C04 whether or not the copy mode shift switch 124 was turned on during the current cycle of iteration of the main routine program. When the answer for this step C04 is given in the negative, the system also recycles the subroutine program A04. On the other hand, if it is found at the step C04 that the switch 124 was turned on during the current cycle of iteration of the main routine program, it is further questioned at step C05 whether or not the indicator 124a associated with the switch 124 is turned on. If the indicator 124a is found to be turned on, the particular indicator 124a is turned off at step C06 and the edited copy mode request signal $S_{EC1}$ is shifted to a logic "0" level at step C07 to cancel the edited copy mode based on the signals from the control panel 100. If it is found at the step C05 that the indicator 124a is turned off, the indicator 124a is turned on at step C08 and the edited copy mode request signal $S_{EC1}$ is shifted to a logic "1" level at step C09 to set up the edited copy mode based on the signals from the control panel 100. Subsequently to the step C07 or C09, the system recycles the subroutine program A04.

Edited Area Coordinate Display Subroutine (A05)

Figure 11:
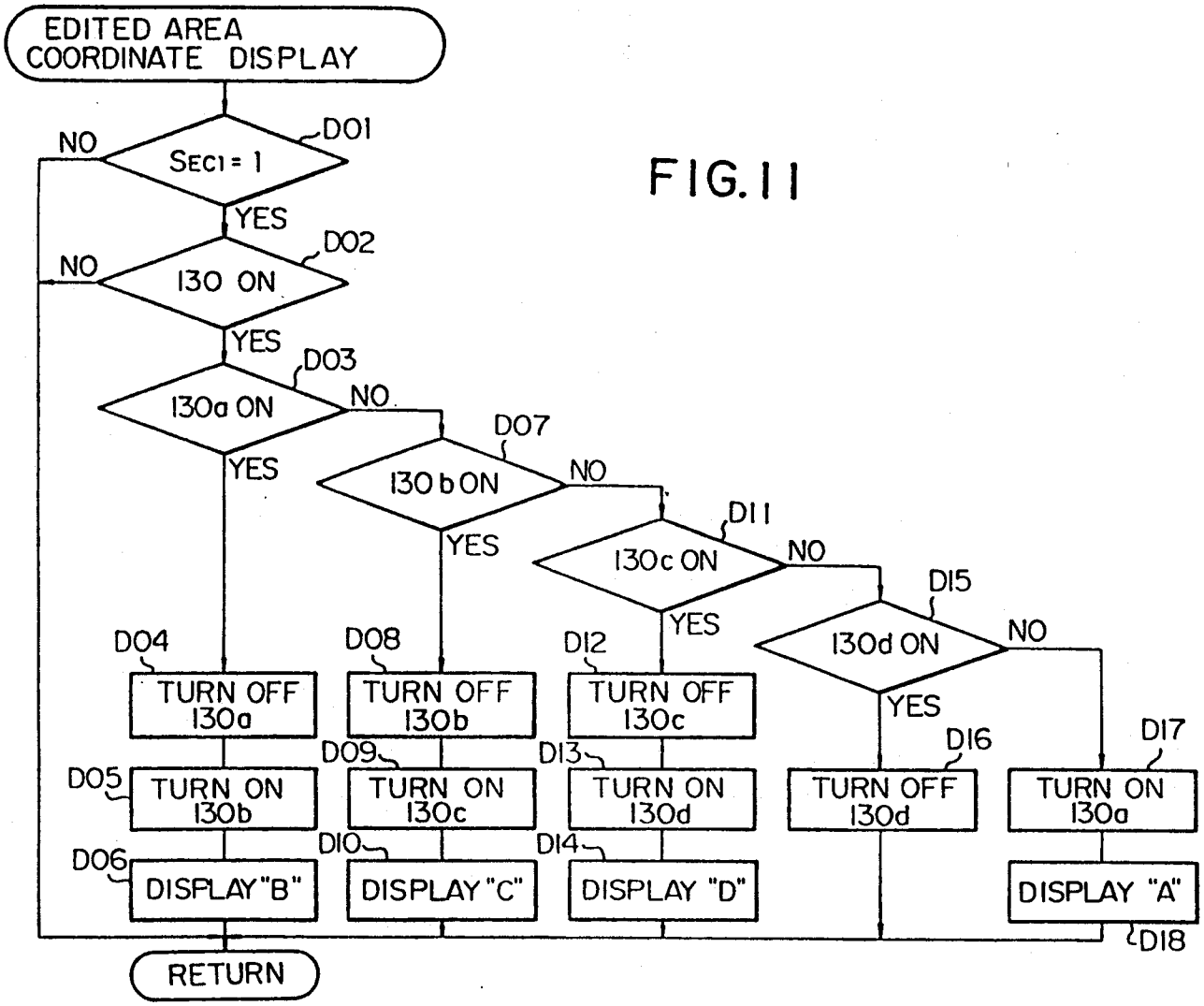
FIG. 11 is a flowchart showing an edited area coordinate display subroutine program also included in the main routine program illustrated in FIG. 7.

Referring to FIG. 11, the edited area coordinate display subroutine program A05 starts with a decision step D01 to determine whether or not the edited mode of copying operation is requested from the control panel 100. Thus, it is questioned at the step D01 whether or not the indicator 124a associated with the copy mode shift switch 124 is turned on or, in other words, the edited copy mode request signal $S_{EC1}$ is of a logic "1" level. If it is determined that the indicator 124a is turned off in the presence of the signal $S_{EC1}$ of a logic "0" level, the system waits until the edited copy mode is established with the indicator 124a turned on. If it is found at the step D01 that the indicator 124a is turned on in the presence of the signal $S_{EC1}$ of a logic "1" level, it is further tested at step D02 whether or not the coordinate enter switch 130 is turned on. If the switch 130 is found to be turned off, the system waits until the switch 130 is turned on. When it is found at the step D02 that the switch 130 is turned on, it is then confirmed at step D03 whether or not the first indicator 130a associated with the switch 130 is turned on. If the indicator 130a is found to be turned on, the particular indicator 130a is turned off at step D04 and, in turn, the second indicator 130b associated with the switch 130 is turned on at step D05, whereupon the coordinate "B" corresponding to the indicator 130b is read out from the memory 222 and is visually indicated on the display window 106 as at step D06. In like manners, the coordinates "C" and "D" corresponding to the third and fourth indicators 130c and 130d, respectively, are indicated on the display window 106 at steps D07 to D14. Furthermore, if it is found at step D15 that the fourth indicator 130d associated with the switch 130 is turned on, the particular indicator 130d is turned off at step D16 and the system recycles to the subroutine program A05. If it is found at the step D15 that the fourth indicator 130d is turned off so that none of the indicators 130a to 130d is turned on, the indicator 130a is turned on at step D17 and the coordinate "A" corresponding to the indicator 130d is indicated on the display window 106 as at step D18.

Erase/Copy Area Shift Subroutine (A06)

Figure 12:
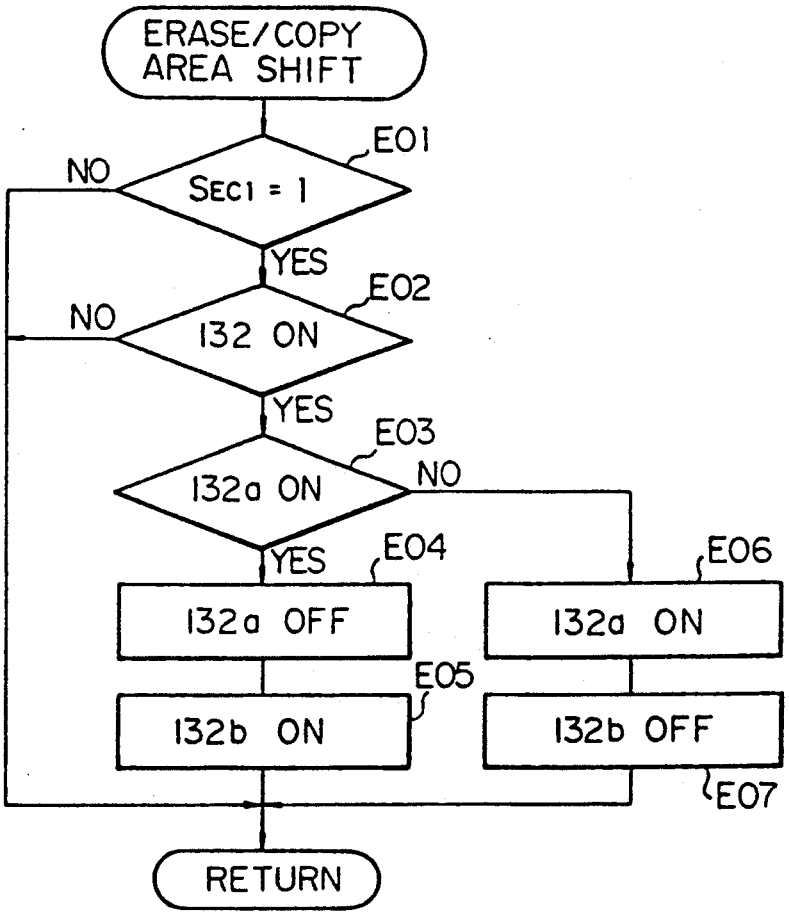
FIG. 12 is a flowchart showing an erase/copy area shift subroutine program also included in the main routine program illustrated in FIG. 7.
Figure 13:
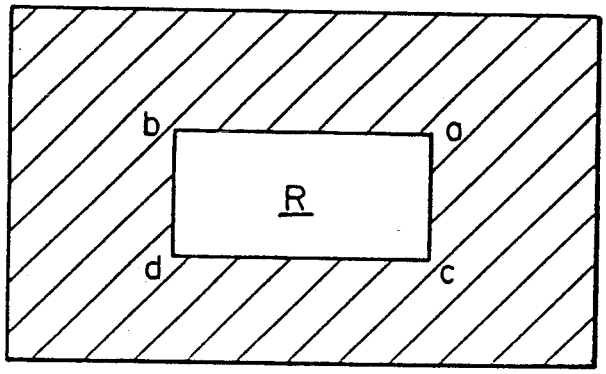
FIG. 13 is a plan view similar to FIG. 9 but shows the edited copy area which is to be erased.
Figure 14:
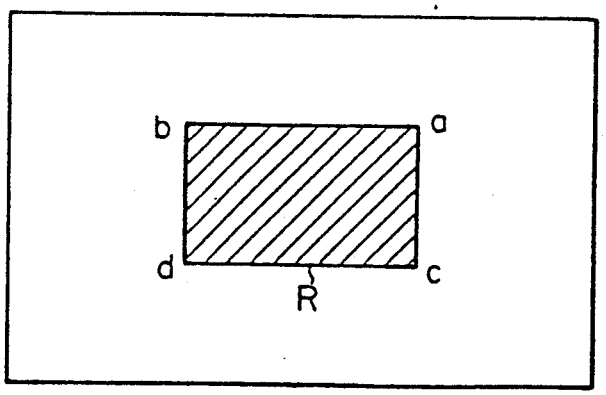
FIG. 14 is a plan view also similar to FIG. 9 but shows the edited copy area which is to be reproduced.

Referring to FIG. 12, the erase/copy area shift subroutine program A06 with a decision step E01 to determine whether or not the edited mode of copying operation is requested from the control panel 100. It is thus questioned at the step E01 whether or not the indicator 124a associated with the copy mode shift switch 124 is turned on, viz., the edited copy mode request signal SECl is of a logic "1" level. If the indicator 124a is found to be turned off, the system waits until the indicator 124a is turned on. When it is found at the step E01 that the indicator 124a is turned on in the presence of the signal $S_{EC1}$ of a logic "1" level, it is questioned at step E02 whether or not the area erase switch 132 was turned on during the current cycle of iteration of the main routine program. If the answer for the step E02 is given in the negative, the system waits until the particular switch 130 is turned on. When it is found at the step E02 that the switch 132 was turned on during the current cycle of iteration of the main routine program, it is further questioned at step E03 whether or not the first indicator 132a associated with the switch 132 is turned on with the "inside area" erase mode selected. If the indicator 132a is found to be turned on, the particular indicator 132a is turned off at step E04 and, in turn, the second indicator 132b associated with the switch 132 is turned on at step E05. A shift is accordingly made from the "inside area" erase mode to the "outside area" erase mode of edited copying operation so that the images outside the edited copy area R defined by the coordinate points $P_1$, $P_2$, $P_3$ and $P_4$ are to be erased, as shown in FIG. 13. If it is found at the step E03 that the indicator 132a is turned off, the particular indicator 132a is turned on at step E06 and the second indicator 132b is turned off at step E07. A shift is thus made from the "outside area" erase mode to the "inside area" erase mode of edited copying operation so that the images within the edited copy area R defined by the coordinate points $P_1$, $P_2$, $P_3$ and $P_4$ are to be erased, as shown in FIG. 14.

Copying Operation Control Subroutine (A07)

Figure 15A:
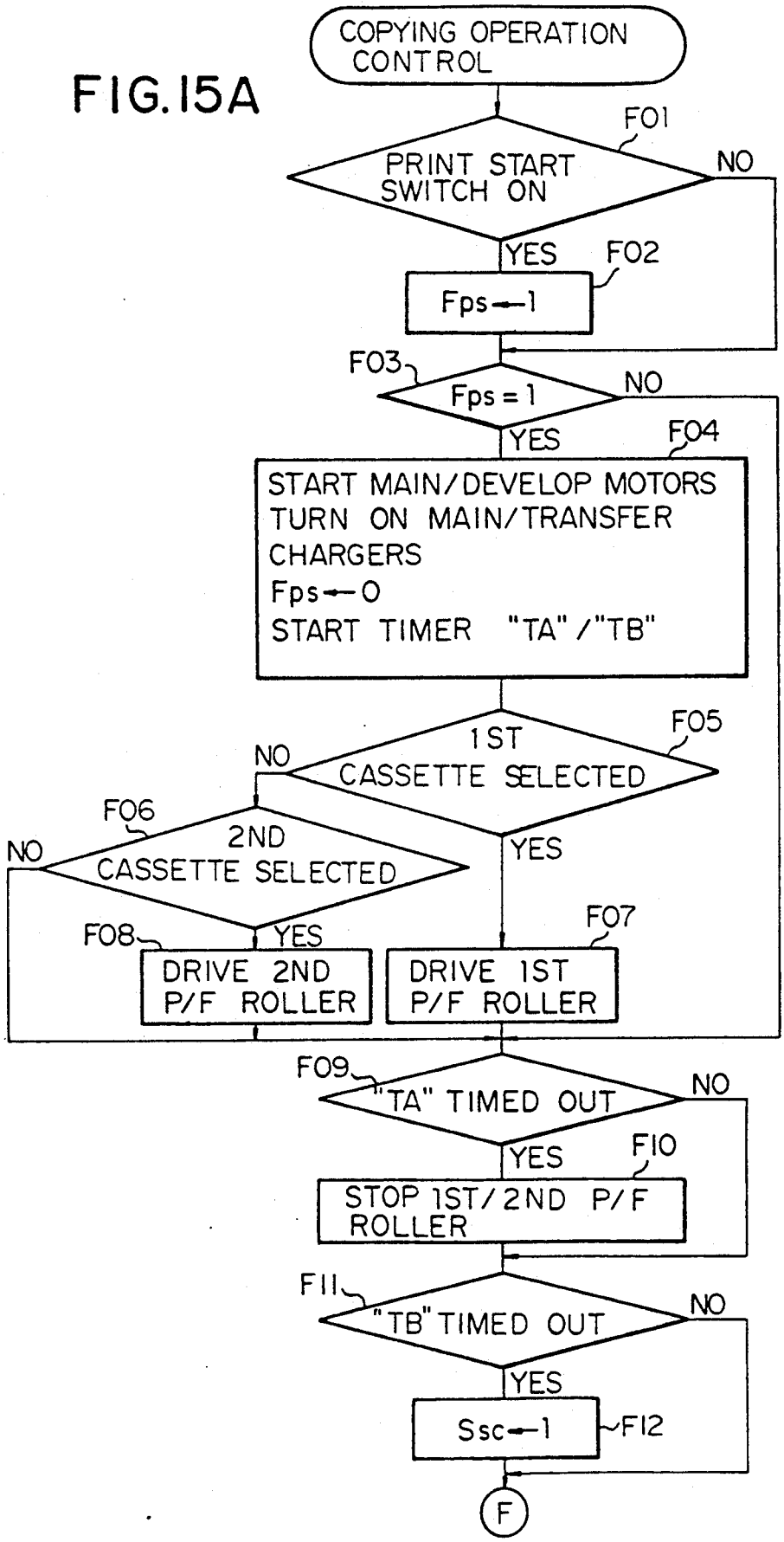
FIGS. 15A and 15B are flowcharts showing a copying operation control subroutine program further included in the main routine program illustrated in FIG. 7.

Referring to FIG. 15A, the copying operation control subroutine program A07 starts with a decision step F01 to confirm whether or not the print start switch 102 is depressed. When it is found that the print start switch 102 is turned on, a print start flag $F_{ps}$ is shifted to a logic "1" level at step F02 and, thereupon, it is confirmed at step F03 whether or not the print start flag $F_{ps}$ is of a logic "1" level. If the answer for this step F03 is given in the affirmative, the print start flag $F_{ps}$ is shifted to a logic "0" level and signals are issued to activate the drivers and actuators for the main drive motor 50, the motor in the developing unit 54, and the chargers 52, 56, 58 and 64. At this step F04 are also started internal timers TA and TB of the CPUl 200. The timer TA of the CPUl 200 is predominant over the time when each of the clutches for the paper feed rollers 72 and 74 is to be de-energized and the timer TB of the CPUl 200 is predominant over the time at which the document scanning system 24 is to be initiated into motion.

Subsequently to the step F04, it is determined at step F05 or through steps F05 and F06 which of the first and second paper supply cassettes 68 and 70 is currently selected. This decision is made depending on the status of each of the indicators 112a to 112d associated with the paper size select switch 112. On the basis of the result of this decision, a signal is issued at step F07 or step F08 to actuate either the clutch for the first paper feed roller 72 or the clutch for the second paper feed roller 74 to feed a copying sheet from the paper supply cassette 68 or 70. When it is thereafter confirmed at step F09 that the time set by the timer TA is reached, a signal is issued at step F10 to de-energize the clutch for the paper feed roller 72 or 74 which has been in operation. When it is thereafter confirmed at step F11 that the time set by the timer TB is reached, a document scanning signal $S_{SC}$ of a logic "1" level is issued at step F12 and is transferred to the second CPU2 202 to enable the document scanning system 24 to start the optical scanning operation.

Figure 15B:
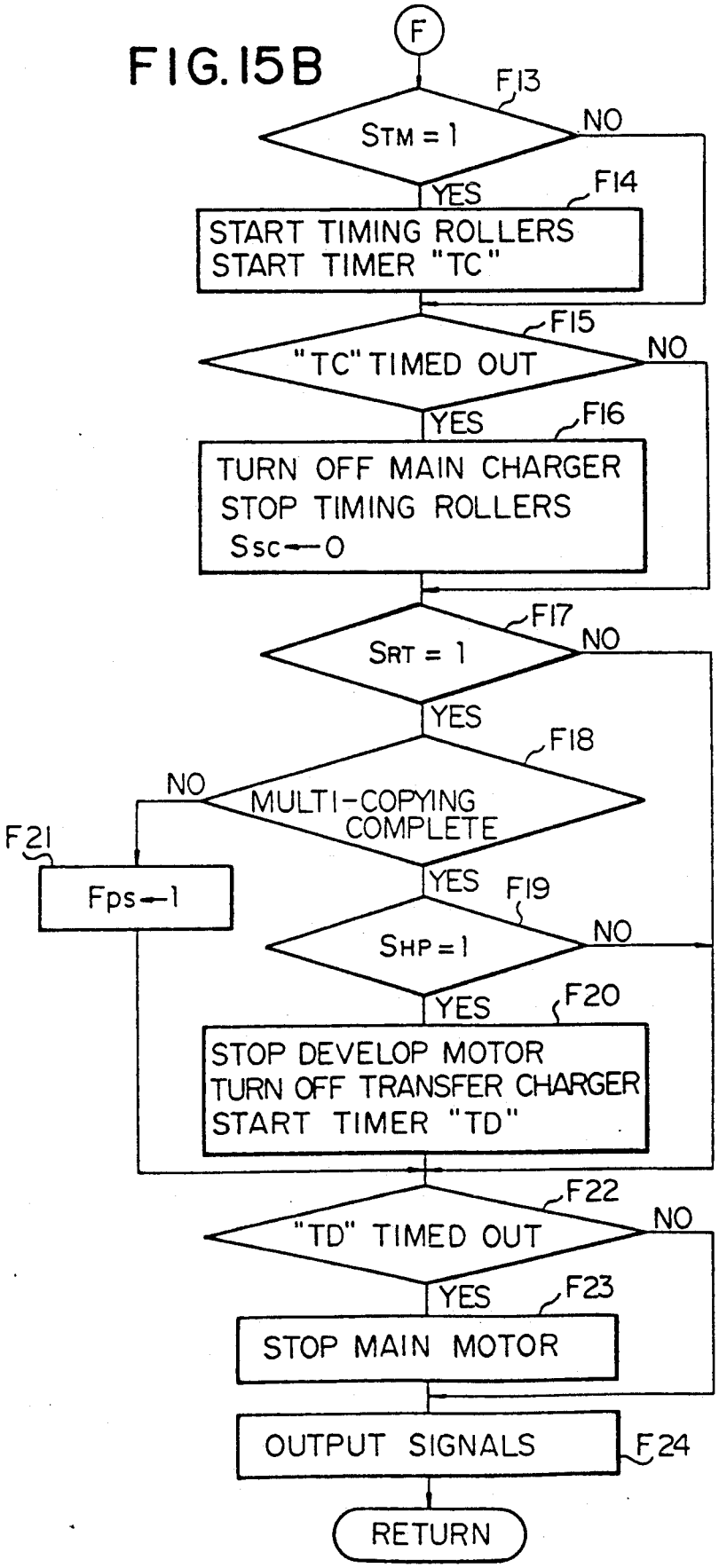

The subroutine program A07 then jumps through a connector F to the steps shown in FIG. 15B and questions whether or not there is a timing signal $S_{TM}$ of a logic "1" level transferred from the second CPU2 202. The timing signal $S_{TM}$ of logic "1" level is issued when the timing sensor 94 detects that the document scanner 32/34 has reached a predetermined position after the scanner was initiated into forward movement from its home position. When it is found at the step F13 that such a timing signal $S_{TM}$ of logic "1" level is present, a signal is issued at step F14 to actuate the clutch for the timing rollers 84 so that the copying sheet which has reached the timing rollers 84 is allowed to advance into contact with the rotating image transfer drum 48. At this step F14 is further started an internal timer TC of the CPUl 200. The timer TC of the CPUl 200 is predominant over the time at which the scanning operation by the system 24 is to be terminated and the clutch for the timing rollers 84 is to be de-energized. The time thus counted by the timer TC is a parameter dictated by the selected size of the copying sheet and the selected magnification ratio of copying. When it is confirmed at step F15 that such a time is reached, signals are issued at step F16 to de-activate the main charger 52, terminate the operation by the scanning system 24 with the scanning signal $S_{SC}$ shifted to a logic "0" level, and de-energize the clutch for the timing rollers 84.

Subsequently to the step F16, it is confirmed at step F17 whether or not a scanner return signal $S_{RT}$ is of a logic "1" level. This scanner return signal $S_{RT}$ is transferred from the second CPU 202 on the basis of the signal produced by the timing sensor 96 when the scanner 32/34 reaches the predetermined foremost position with respect to the document table 22. On transition of the scanner return signal $S_{RT}$ to logic "1" level, the document scanner 32/34 starts to travel back to its home position. If the current copying operation is of the multi-copying mode requiring to produce two or more copy prints for a single document, it is confirmed at a subsequent step F18 whether or not the copying cycles have been repeated the required number of times. If it is confirmed that the multi-copying operation is complete, it is further confirmed at step F19 whether or not a home position signal $S_{HM}$ transferred from the second CPU2 202 to the first CPUl 200 on the basis of the signal from the home position sensor 92 is of a logic "1" level. At a point of time the document scanner 32/34 reaches its home position and accordingly the home position signal $S_{HM}$ is shifted to logic "1" level, signals are issued at step F20 to stop the motor in the developing unit 54 and de-activate the transfer charger 56. At this step F20 is further started an internal timer TD which is predominant over the time when the main drive motor 50 is to be brought to a stop. If it is found at the step F18 that the multi-copying operation is still incomplete, then the print start flag $F_{ps}$ is shifted to a logic "1" level at step F21 to complete the required multicopying operation. When it is confirmed at step F22 that the time set by the timer TD is reached, a signal is issued to stop the motor 50 at step F23 and thereafter control signals are transferred from the first CPUl 200 to other CPUs including the second CPU2 202 and third CPU3 204.

Coordinate Re-ordering Subroutine (A08)

Figure 16:
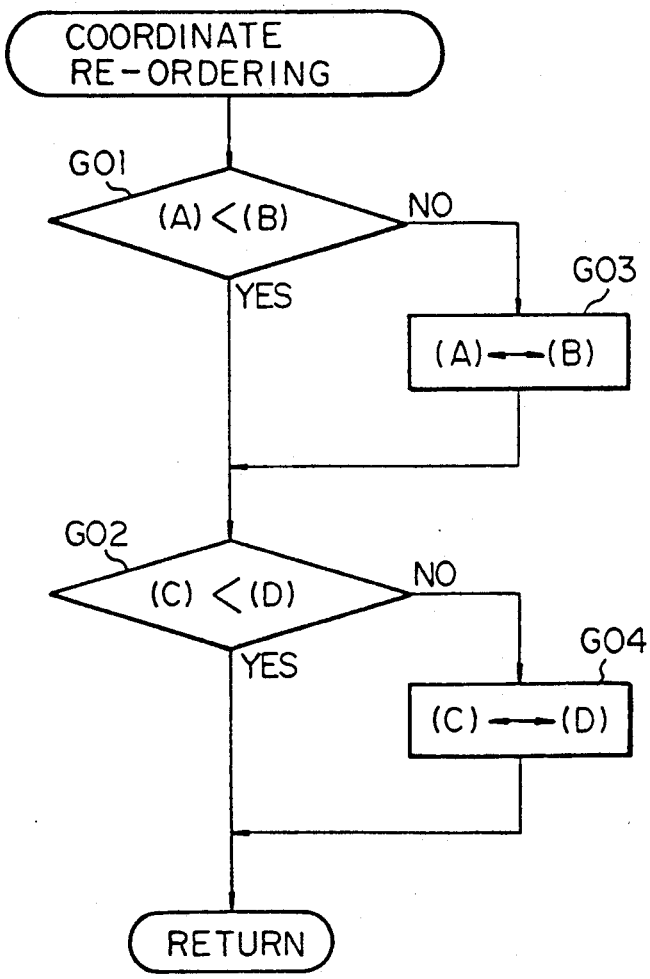
FIG. 16 is a flowchart showing a coordinate re-ordering subroutine program also included in the main routine program also illustrated in FIG. 7.

Turning to FIG. 16, the coordinate re-ordering subroutine program A08 starts with a decision step G01 in which the two x-coordinates "A" and "B" which have been entered from any of the coordinate select switches 128a to 128d are compared with each other to determine which of the two is larger than the other. If it is determined by this step G01 that the x-coordinate "A" is smaller than the x-coordinate "B", then the two y-coordinates "C" and "D" entered from any of the coordinate select switches 128e to 128h are compared with each other to determine which of the two is larger than the other. If it is determined at the step G01 that the x-coordinate "A" is larger than the x-coordinate "B", the two x-coordinates "A" and "B" are exchanged with each other at step G03 prior to the step G02. If it is determined at the step G02 that the y-coordinate "C" is larger than the y-coordinate "D", the two y-coordinates "C" and "D" are likewise exchanged with each other at step G04 prior to the step G02. With the x- and y-coordinates "A", "B", "C" and "D" thus arranged in an increasing order, the system recycles the subroutine program A08.

Selective Erase Control Subroutine (A09)

Figure 17:
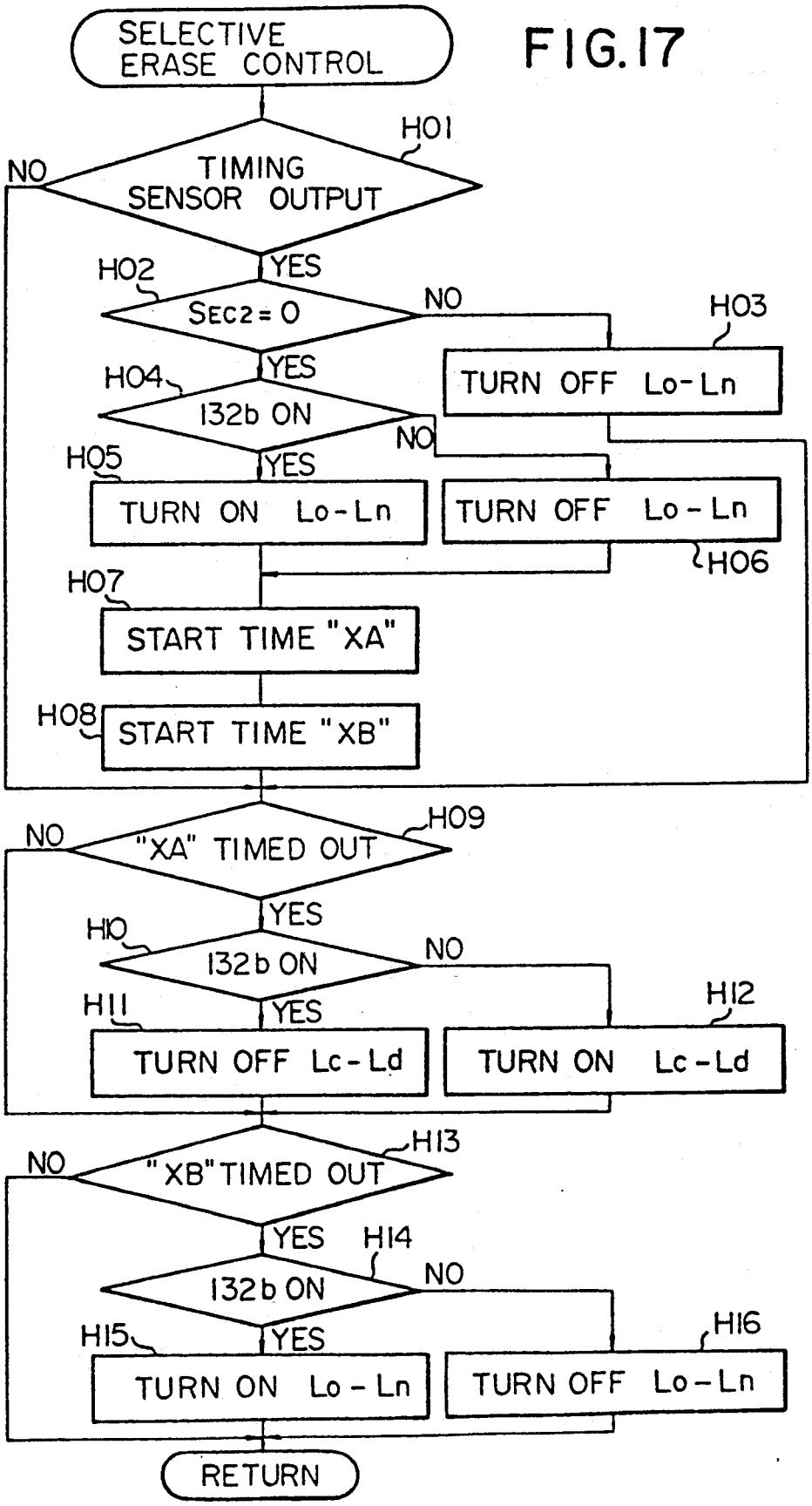
FIG. 17 is a flowchart showing a selective erase control subroutine program also included in the main routine program illustrated in FIG. 7.

Referring to FIG. 17, the selective erase control subroutine program A09 starts with a decision step H01 at which is confirmed whether or not there is transferred from the second CPU2 202 a signal indicating that the document scanner 32/34 has forwardly travelled a predetermined distance from its home position. Such a signal may be produced on the basis of the signal of logic "1" level produced from the timing sensor 94 after the print start switch 102 is depressed. The step H01 is followed by step H02 at which it is questioned whether or not there is present the edited copy mode request signal $S_{EC2}$ of a logic "0" level. If it is found that this edited copy mode request signal $S_{EC2}$ from the editor module 138 has a logic "1" level, a signal is issued at step H03 for provisionally de-activating all of the light emitter elements 134 (Lo to Ln) of the eraser unit 98. If it is found at the step H02 that the signal $S_{EC2}$ has a logic "0" level, it is questioned at step H04 whether or not the "inside area" erase indicator 132*b* associated with the area erase switch 132 is turned on. If the indicator 132*b* is found to be turned on, a signal is issued at step H05 for activating all of the light emitter elements 134 of the eraser unit 98 and thereafter internal timers XA and XB are started at steps H07 and H08, respectively. The internal timers XA and XB are predominant over the times TA and TB (FIG. 4) which are set on the basis of the re-ordered x-coordinates "A" and "B", respectively. If it is found at the step H04 that the indicator 132*b* is found to be turned off, a signal is issued at step H06 for deactivating all of the light emitter elements 134 of the eraser unit 98 and thereafter the timers XA and XB are started at the steps H07 and H08, respectively.

Upon lapse of the time TA set by the timer XA as confirmed at step H09, it is tested at step H10 whether or not the indicator 132*b* is turned on. If the indicator 132*b* is found to be turned on, a signal is issued at step H11 for de-activating the selected ones $L_C$ to $L_D$ (FIGS. 3 and 4) of the light emitter elements 134 of the eraser unit 98 on the basis of the numerical data representative of the re-ordered y-coordinates "C" and "D". If it is found at the step H09 that the indicator 132*b* is found to be turned off, a signal is issued at step H12 for activating the selected ones $L_C$ to $L_D$ of the light emitter elements 134 of the eraser unit 98 also on the basis of the numerical data representative of the re-ordered y-coordinates "C" and "D". When it is thereafter confirmed at step H13 that the time TB set by the timer XB has lapsed, it is tested at step H14 whether or not the indicator 132*b* is turned on. If the indicator 132*b* is found to be turned on, a signal is issued at step H15 for activating all the light emitter elements 134 of the eraser unit 98. If it is found at the step H13 that the indicator 132*b* is found to be turned off, a signal is issued at step H16 for de-activating all the light emitter elements 134 of the eraser unit 98. After the light emitter elements 134 of the eraser unit 98 are thus all activated or de-activated at the step H15 or H16, the system recycles the subroutine program A08.

Control Routine of CPU3

Figures 18A, 18C:
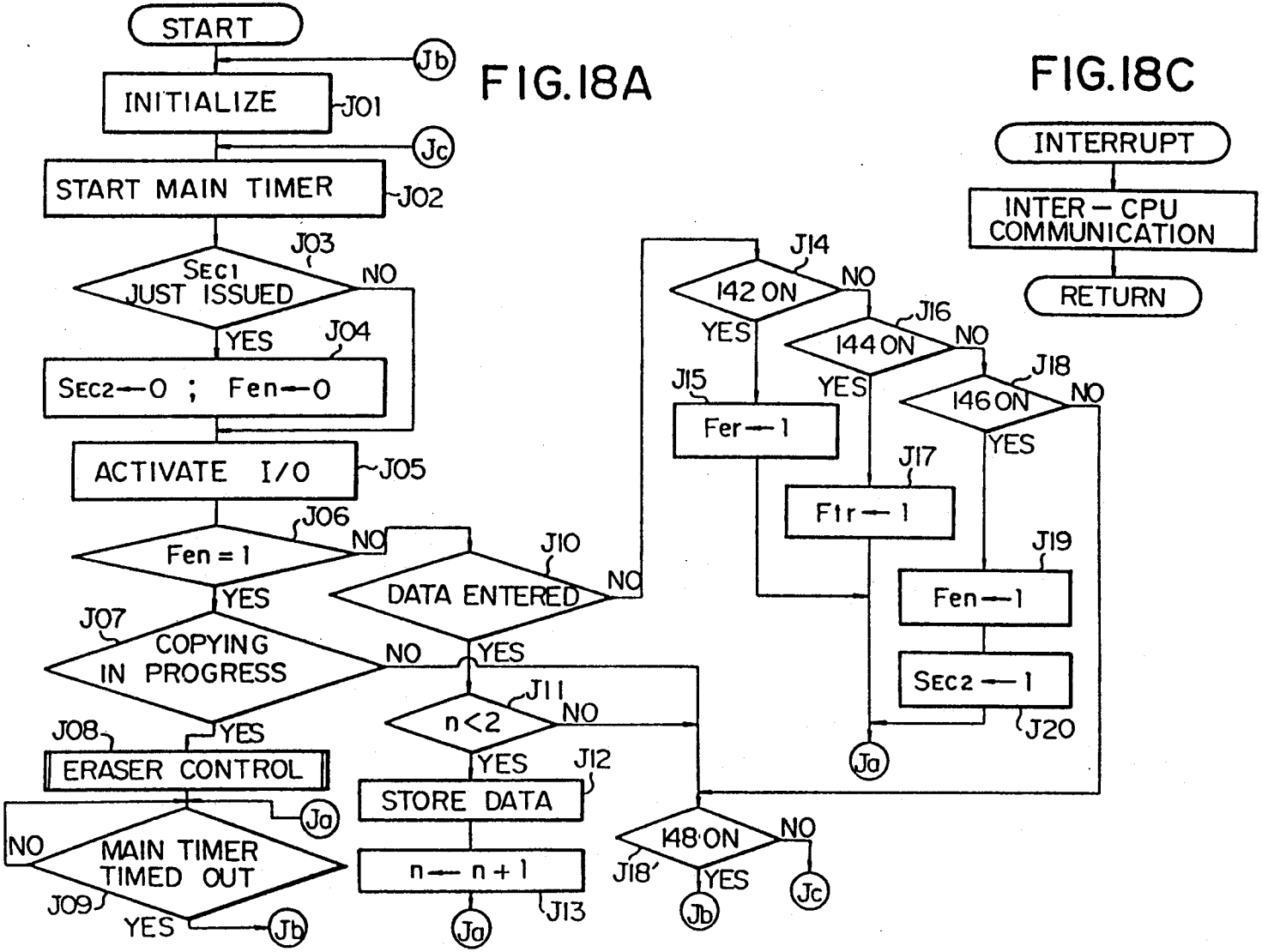
FIGS. 18A, 18B and 18C are flowcharts showing a selective erase control routine program to be executed by the third microprocessor included in the control circuit illustrated in FIG. 6.
Figure 18B:
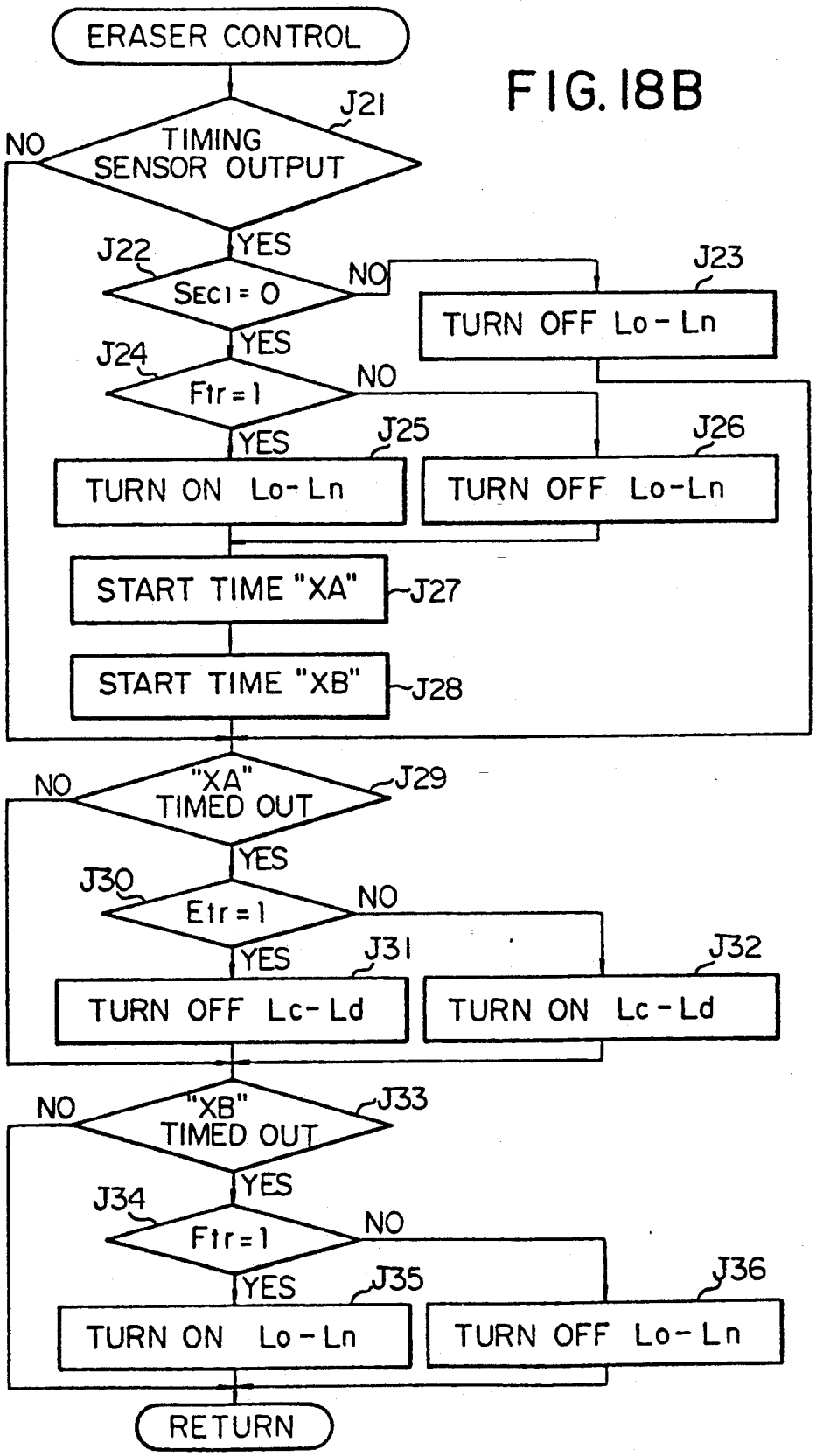

FIGS. 18A, 18B and 18C show a selective erase control routine program to be executed by the third CPU3 204 included in the control circuit illustrated in FIG. 6.

Referring to FIG. 18A, such a selective erase control routine program starts with step J01 at which the system of the CPU3 204 is initialized so that all the copying conditions and modes of operation to be controlled by the CPU3 204 are selected in accordance with prescribed default rules. An internal timer of the system is then initiated at step J02 to count the time interval predetermined for a single complete iteration through the routine program.

The step J02 is followed by a decision step J03 at which it is determined whether or not the edited mode of copying operation was requested from the control panel 100 during the current cycle of iteration of the main routine program. For this purpose, it is questioned at the step J03 whether or not the edited copy mode request signal $SEC_1$ of logic "1" level was issued from the control panel 100 during the current cycle of iteration of the main routine program. When it is determined that the indicator 124*a* is turned on, the edited copy mode request signal $S_{EC2}$ is swung to logic "0" level and an end flag Fen swung to logic "0" level at step J04. If the edited mode of copying operation may have been requested from the editor module 138, such a request is cancelled when it is found at the step J03 that the edited copy mode is newly requested from the control panel 100. The step J04 is follows by step J05 at which input and outputs are activated.

It is then confirmed at step J06 whether or not the end flag Fen is of a logic "1" level. If the flag Fen is found to be of logic "1" level, it is further tested at step J07 whether or not copying operation is currently in progress. This decision is made on the basis of a signal transferred from the first CPUl 200. If it is found at the step J07 that copying operation is in progress, the system proceeds through a control subroutine J08 to a decision step J09.

If it is determined at the step J06 that the end flag Fen is of logic "1" level, it is further tested at step J10 whether or not there is any numerical coordinate data entered from the editor module 138. This decision is made through detection of a transition of the logic state of an x- or y-coordinate which may be loaded into the CPU3 204 from the editor module 138 by way of the analog-to-digital converter 236. If it is found at the step J10 that there is any coordinate data entered from the editor module 138, it is tested at step J11 whether or not the tablet 140 of the editor module 138 has been pressed upon an n number of times less than two. If the answer for this step J11 is given in the affirmative, the electric signals produced by the tablet 140 as a result of the application of pressure are stored as the coordinate data at step J12. The value n is then incremented by one at a subsequent step J13, which is followed by the decision step J09 through a connector Ja. It may be herein noted that the edited copy area R specified in the current copying operation is assumed to be rectangular so that only two electric signals suffice as the coordinate data and, for this reason, the value n is less than two ("0" and "1").

If it is found at the step J10 that there currently is no coordinate data entered from the editor module 138, it is confirmed at step J14 whether or not there is a signal requesting the "inside area" erase mode as produced from the erase switch 142 of the editor module 138. If it is found that there is such a signal, an erase flag $F_{er}$ is shifted to a logic "1" level at step J15, which is followed through the connector Ja by the decision step J09. If it is determined at the step J14 that there is no "inside area" erase mode signal, it is then questioned at step J16 whether or not there is a signal requesting the "outside area" erase mode as produced from the trimming switch 144 of the editor module 138. If it is found that there is such a signal, a trimming flag $F_{tr}$ is shifted to a logic "1" level at step 17, which is also followed through the connector Ja by the decision step J09. If it is determined at the step J16 that there is no "outside area" erase mode signal, it is questioned at step J18 whether or not there is a signal produced from the end switch 146 of the editor module 138. If it is found that there is such a signal present, the end flag $F_{en}$ is shifted to a logic "1" level at step J19 and the edited copy mode request signal $SEC_2$ is shifted to a logic "1" level at step J20, which is also followed through the connector Ja by the decision step J09.

If it is determined at the step J07 that there is no copying operation currently in progress, if the value is found to be two at the step J11, or if it is found at the step J18 that the end switch 146 is not depressed, then the system proceeds to a decision step J18' to confirm whether or not there is a signal requesting to clear the edited copy mode as produced from the clear switch 148 of the editor module 138. If it is found that there is such a signal, the step is followed through a connector Jb by the initializing step J01 and, if to the contrary, followed through a connector Jc by the step J02.

The subroutine program J08 consists of steps J21 to J36 as shown in FIG. 18B which are similar to the steps H01 to H16, respectively, of the selective erase control subroutine program A09 described with reference to FIG. 17 except for the step J22 at which it is tested whether or not there is present the edited copy mode request signal $S_{EC1}$ of a logic "1" level. If it is found that the edited copy mode request signal $S_{EC2}$ has a logic "1" level, a signal is issued at step J23 for provisionally de-activating all of the light emitter elements 134 of the eraser unit 98 as in the step H03 in the subroutine program A09. If it is found at the step J22 that the signal $S_{EC2}$ has a logic "0" level flag, then the step J22 is followed by the step J24 which is similar to the step H04 in the subroutine program A09. When there is a request for interrupt from the first CPUl 200 to the third CPU3 204, the two CPUs communicate with each other as schematically shown in FIG. 18B.

As will have been understood from the foregoing description that, when the edited mode of copying operation is requested from the control panel 100 after a similar mode of operation is requested from the editor module 138, the request from the latter is cancelled (as by the steps J03 and J04) and, when the edited mode of copying operation is requested from the editor module 138 after a similar mode of operation is requested from the control panel 100, the request from the latter is also cancelled (as by the steps C01, C02 and J22). Thus, when the edited mode of copying operation is requested from one of the control panel 100 and editor module 138 and thereafter a similar mode of operation is requested from the other thereof, the request from the former is disregarded provisionally. This enables the operator of the apparatus to clearly know the preferential order of the operations to be performed through the control panel 100 and editor module 138 so that he will be able to avoid performing an undesired edited mode of copying operation. The coordinate data once entered from the control panel 100 are stored into the memory 222 and can be used for the edited mode of copying operation subsequent to the edited mode of copying operation performed on the basis of the signals from the editor module 138.

While it has been described that the editor module 138 is used as the external editing data input means in the embodiment of the present invention, any other types of devices such as personal computers and memory devices may be used as such data input means insofar as the device has edited image forming and numerical data entering capabilities. Where a personal computer is used as the external editing data input means, the desired quantity of the copy prints to be produced, the desired magnification ratio of copying and other parameters may be entered from the keyboard unit of the computer and transmitted to the CPUs of the apparatus to enable the apparatus to perform the copying operation in accordance with the desired conditions. If, on the other hand, a memory card storing an edited copy mode and data therefor is used on any readout device, an edited mode of copying operation may be carried out on the basis of the data thus read out from the card. Where, furthermore, a digital copier is used as the image forming apparatus according to the present invention, an image reader may be utilized as the external editing data input means. In this instance, the data of the images read by the image reader per se may be used either as they are or after they have been processed in any fashion but the data of the images entered from the digital copier are left unused. Where the present invention is applied to a digital copier, the later selected one of the image forming operation based on the data from the digital copier and the image forming operation based on the data from the image will be performed on priority.

What is claimed is:

1. An image duplicating apparatus comprising a) a main body including
   copying means capable of copying images on a desired area of a document,
   first input means for entering data designating said desired area of the document, and
   memory means for storing the data entered by said first input means, b) an additional device connectable to said main body and comprising second input means for entering data designating said desired area of the document, c) first control means for controlling said copying means on the basis of the data stored in said memory means, d) second control means for controlling said copying means on the basis of the data entered by said second input means when the data is entered from said second input means with data preliminarily stored in said memory means by said first input means, said second control means being further operative to maintain said first control means inoperative, and e) memory control means for controlling said memory means for retaining the preliminarily stored data therein.

2. An image duplicating apparatus comprising ( a) a main body including copying means capable of copying images on a desired area of a document, and first input means for entering data designating said desired area of the document, b) an additional device connectable to said main body and comprising second input means for entering data designating said desired area of the document, c) memory means for storing the data entered by each of said first and second input means, and d) control means for controlling said copying means on the basis of the data stored in said memory means, said control means being operative to control said copying means on the basis of the data which is entered from one of said first and second input means while maintaining inaccessible the data previously entered from the other of the first and second input means.

3. An image duplicating apparatus comprising a main body including copying means capable of copying images on a desired area of a document, and first input means for entering data designating said desired area of the document, an additional device connectable to said main body and comprising second input means for entering data designating said desired area of the document, memory means for storing the data entered by said first input means and said second input means, control means for controlling said copying means on the basis of the data stored in said memory means during a first mode of operation, and on the basis of the data stored in said memory means during a second mode of operation, and mode shifting means for selecting said first mode of operation in response to operation of said first input means and selecting said second mode of operation in response to operation of said second input means, said mode shifting means being operative to select the mode of operation corresponding the later operated input means while cancelling a preliminarily selected mode of operation.

4. An image duplicating apparatus having an ordinary copy mode and an edited mode of copying operation, comprising a) image forming means responsive to given image information for reproducing images on the basis of the image information, b) first and second input means each for entering a mode select signal for selecting one of said ordinary copy mode and said edited mode of copying operation and data for use in the edited mode of copying operation, and c) control means for conditioning said image forming means to reproduce said images in said edited mode of copying operation in response to the mode select signal from each of said first and second input means, d) wherein, when the edited mode of copying operation is selected by the mode select signal from one of said first and second input means and concurrently by the mode select signal from the other of the first and second input means and the respective mode select signals from the first and second input means are output one after the other, said control means is operative to condition said image forming means to reproduce said images preferentially in the edited mode of copying operation dictated by the later output mode select signal and automatically cancel the earlier output mode select signal.

5. An image duplicating apparatus as set forth in claim 4, further comprising memory means for storing said data entered by said first and second input means so that, when the edited mode of copying operation is selected by one of said first and second input means after the edited mode of copying operation is selected by the other of said first and second input means, said control means is operative to condition said image forming means to reproduce said images in the edited mode of copying operation on the basis of the data entered by the later selected input means.

6. An image duplicating apparatus as set forth in claim 4, in which the data to be entered by each of said first and second input means include numerical coordinate data representative of the coordinates defining an edited copy area within which said images are to be at least partially reproduced in the edited copy mode.

7. An image duplicating apparatus as set forth in claim 6, in which said coordinate data are expressed on a coordinate system with two crossing axes, said control means being further operative to compare the coordinate data on each of said axes for re-ordering the coordinate data in accordance with a prescribed rule for defining said edited copy area.

8. An image duplicating apparatus as set forth in claim 4, in which said image information is provided in the form of optical information produced by optically scanning an image bearing document and in which said image forming means comprises a cylindrical photosensitive drum having a peripheral surface operable for producing electrostatic latent images in response to said optical information.

9. An image duplicating apparatus comprising a) a copying module having an ordinary copy mode and an edited mode of copying operation and including scanning means for optically scanning an image bearing medium and producing optical information on the basis of the images borne by said image bearing medium, image reproducing means responsive to said image information for reproducing images on the basis of the image information, internal input means for entering a mode select signal for selecting one of said ordinary copy mode and said edited mode of copying operation and data for use in the edited mode of copying operation, b) external input means for entering, independently of said internal input means, a mode select signal for selecting one of said ordinary copy mode and said edited mode of copying operation and data for use in the edited mode of copying operation, and c) control means for conditioning said copying module to reproduce said images in said edited mode of copying operation in response to the mode select signal from each of said internal and external input means, d) wherein, when the edited mode of copying operation is selected by the mode select signal from one of said internal and external input means and concurrently by the mode select signal from the other of the internal and external input means and the respective mode select signals from the internal and external input means are output one after the other, said control means is operative to condition said image forming means to reproduce said images preferentially in the edited mode of copying operation dictated by the later output mode select signal.

10. An image duplicating apparatus as set forth in claim 9, further comprising memory means for storing said data entered by said internal input means so that, when the edited mode of copying operation is selected by said external input means after the edited mode of copying operation is selected by said internal input means, said control means is operative to condition said copying module to reproduce said images in the edited mode of copying operation on the basis of the data read from said memory means.

11. An image duplicating apparatus as set forth in claim 9, in which the data to be entered by each of said internal and external input means include numerical coordinate data representative of the coordinates defining an edited copy area within which said images are to be at least partially reproduced in the edited copy mode.

12. An image duplicating apparatus as set forth in claim 11, in which said coordinate data are expressed on a coordinate system with two crossing axes, said control means being further operative to compare the coordinate data on each of said axes for re-ordering the coordinate data in accordance with a prescribed rule for defining said edited copy area.

* * * * *